US005882837A

United States Patent [19]

Sawada

[11] Patent Number: 5,882,837

[45] Date of Patent: Mar. 16, 1999

[54] HEAT-DEVELOPABLE COLOR LIGHT-SENSITIVE MATERIAL

[75] Inventor: Satoru Sawada, Kanagawa, Japan

[73] Assignee: Fuji Photo Film Co., Ltd., Kanagawa, Japan

[21] Appl. No.: 728,796

[22] Filed: Oct. 10, 1996

Related U.S. Application Data

[63] Continuation-in-part of Ser. No. 563,019, Nov. 27, 1995, abandoned.

[30] Foreign Application Priority Data

Nov. 25, 1994 [JP] Japan ..... 6-314226

[51] Int. Cl.[6] ..... G03C 8/00

[52] U.S. Cl. ..... 430/203; 430/217; 430/226; 430/503; 430/509; 430/568; 430/944

[58] Field of Search ..... 430/203, 509, 430/567, 558, 226, 568, 955, 559, 944, 217, 362, 363, 570, 503

[56] References Cited

U.S. PATENT DOCUMENTS

| | | | |
|---|---|---|---|
| 3,615,533 | 10/1971 | Rauner . | |
| 4,619,892 | 10/1986 | Simpson et al. | 430/505 |
| 4,713,319 | 12/1987 | Aono et al. . | |
| 5,413,902 | 5/1995 | Hara et al. | 430/503 |
| 5,503,969 | 4/1996 | Uehara et al. | 430/559 |

FOREIGN PATENT DOCUMENTS

| | | |
|---|---|---|
| 2003646 | 11/1969 | France . |
| 3526315 | 1/1986 | Germany . |
| 06301179 | 10/1994 | Japan . |

*Primary Examiner*—Thorl Chea

*Attorney, Agent, or Firm*—Sughrue, Mion, Zinn, Macpeak & Seas, PLLC

[57] ABSTRACT

Described is a heat developable color light-sensitive material comprising a support having provided thereon at least two layers having a spectral sensitivity peak in a different wavelength range of 700 nm or more, in which the at least two layers are each combined with a compound which provides a dye having a different hue, wherein the layer having a spectral sensitivity peak in the longest wavelength and/or a light-insensitive interlayer adjusted thereto comprises (a) a high silver chloride emulsion of fine grains having a silver chloride content of 80 mol % or more and an average size of 0.15 $\mu$m or less or (b) an easily soluble silver salt compound.

12 Claims, No Drawings

HEAT-DEVELOPABLE COLOR LIGHT-SENSITIVE MATERIAL

This is a Continuation-in-Part of application Ser. No. 08/563,019 filed Nov. 27, 1995, now ababdoned.

FIELD OF THE INVENTION

The present invention relates to a heat-developable color light-sensitive material. More particularly, the present invention relates to a heat-developable color light-sensitive material on which electric signaled-image data can be recorded via a light-emitting element to form a stable image. Furthermore, the present invention relates to a heat-developable color light-sensitive material which exhibits a minimized image density change against the processing temperature change during the heat development and a minimized image color balance change against the change in environmental conditions (particularly temperature) during exposure and provides an image with an excellent discrimination between image area and non-image area.

BACKGROUND OF THE INVENTION

A heat-developable color light-sensitive material is known in the art. For example, heat-developable light-sensitive materials and processes thereof are described in *Shashin Kogaku no Kiso* (*Principle of Photographic Engineering*), edition of non-silver salt system photography, published by Corona Co., 1982, pp. 242–255, and U.S. Pat. No. 4,500,626.

Furthermore, a method which comprises the coupling reaction of an oxidation product of a developing agent with a coupler to form a dye image is described in U.S. Pat. Nos. 3,761,270 and 4,021,240. Also, a method which comprises bleaching a photosensitive silver dye to form a positive color image is described in U.S. Pat. No. 4,235,957.

A method has been recently proposed which comprises allowing imagewise release or formation of a diffusible dye by a heat development, and then transferring the diffusible dye to a dye-fixing element. In this method, both negative and positive dye images can be obtained by altering the kind of dye-providing compounds used or the kind of silver halides used. Specifically, this method is described in U.S. Pat. Nos. 4,500,626, 4,483,914, 4,503,137, 4,559,290, JP-A-58-149046 (The term "JP-A" as used herein means an "unexamined published Japanese patent application"), JP-A-60-133449, JP-A-59-218443, JP-A-61-238056, EP-A-220746, EP-A-210660, and JIII Journal of Technical Disclosure 87-6199.

Many methods for obtaining a positive color image by a heat development have been proposed. For example, U.S. Pat. No. 4,559,290 discloses a method which comprises coexisting a reducing agent or a precursor thereof with an oxidized DRR compound having no capability of releasing a dye image, oxidizing the reducing agent depending on the exposure of silver halide by a heat development, and reducing the oxidized DDR compound to release a non-diffusible dye. Further, EP-A-220746 and JIII Journal of Technical Disclosure 87-6199 (vol. 12, No. 22) disclose a heat-developable color light-sensitive material using a compound which releases a nondiffusible dye by a reductive cleavage of N—X bond (wherein X represents an oxygen atom, nitrogen atom or sulfur atom) in the similar mechanism as mentioned above.

In general, conventional color light-sensitive materials have been spectrally sensitized to blue, green and red. In order to record an image data which has been converted to an electrical signal on such a color light-sensitive material, a color CRT (cathode ray tube) is normally used as an exposing light source. However, CRT is unfit to provide a large-sized print.

As writing heads capable of providing a large-sized print, light-emitting diode (LED) and semiconductor laser (LD) have been developed. However, no such writing heads which can perform efficient emission of blue light have been developed.

Accordingly, if LED's are used, it is necessary that three LED's, i.e., near infrared (800 nm) LED, red (670 nm) LED and yellow (570 nm) LED, be combined to provide a light source to which a color light-sensitive material having three layers spectrally sensitized to near infrared, red and yellow ranges, respectively, is exposed. An image recording system having such a mechanism is described in *Nikkei New Material*, Sep. 14, 1987, pp. 47–57. Some systems have been put into practical use.

Further, JP-A-61-137149 discloses a system which comprises three LD's emitting light of 880 nm, 820 nm and 760 nm in combination to form a light source to which a color light-sensitive material having three light-sensitive layers spectral sensitivity to the respective wavelength ranges to perform recording.

When a multi-layer color light-sensitive material which is adapted to be exposed to three different spectral ranges to develop three colors, i.e., yellow, magenta, and cyan, it is usually an important technique for color reproduction to develop these colors without staining colors. In particular, if LED or LD is used as an exposing light source, the light-sensitive material must be designed to such an extent that the three spectral sensitivities are provided in a narrow spectral range (i.e., from the short wavelength side of red to infrared). Therefore, how the overlap of these spectral sensitivities can be minimized is essential for improving color separatability.

As techniques for securing color separatability, a technique increasing the sensitivity towards the short wavelength side and providing a filter layer has been known as described in U.S. Pat. No. 4,619,892. However, the increase in the sensitivity towards the short wavelength side is disadvantageous because fog is formed and aging stability is deteriorated. Accordingly, in the infrared sensitization, high sensitivity can be hardly attained because of desensitization caused by the addition of a dye or low color sensitization efficiency.

To solve these problems, JP-A-4-146431 and JP-A-5-45828 disclose a color light-sensitive material which comprises a J-band type infrared sensitizing dye having a sharp spectral sensitivity to exhibit a good color separation, a high sensitivity and a good storage stability.

However, the heat-developable color light-sensitive material comprising such a J-band type infrared sensitizing dye is disadvantageous in that the resulting image is liable to a great tint change under some environmental conditions, particularly temperature, during exposure.

SUMMARY OF THE INVENTION

It is therefore an object of the present invention to provide a heat-developable color light-sensitive material comprising at least two silver halide emulsion layers having a spectral sensitivity peak in different wavelength ranges of 700 nm or more which exhibits less image density change against the processing temperature change during heat development, less image color balance change against the change in environmental conditions, particularly temperature, during exposure, and an excellent discrimination between the image area and the non-image area.

This and other objects of the present invention have been achieved by a heat developable color light-sensitive material comprising a support having provided thereon at least two layers having a spectral sensitivity peak in a different wavelength range of 700 nm or more, in which the at least two layers are each combined with a compound which provides a dye having a different hue, wherein the layer having a spectral sensitivity peak in the longest wavelength and/or a light-insensitive interlayer(s) adjusted thereto comprises (a) a substantially insensitive, high silver chloride emulsion of fine grains having a silver chloride content of 80 mol % or more and an average size of 0.15 $\mu$m or less or (b) an easily soluble silver salt compound in combination with silver halide having a spectral sensitivity peak in the longest wavelength, wherein "substantially insensitive" herein means that the sensitivity of the high silver chloride emulsion of fine grains is lower than that of the light-sensitive silver halide having a spectral sensitivity peak in the longest wavelength by 1.0 Log E or greater.

DETAILED DESCRIPTION OF THE INVENTION

The color balance change ($\Delta$CB) against the change in exposure conditions as used herein is the greatest in yellow, magenta and cyan density differences and can be defined by the following equation:

$$\Delta CB = MAX[\Delta CB_{YM}, \Delta CB_{MC}, \Delta CB_{CY}]$$

wherein MAX[X] represents the maximum value. Supposing that yellow, magenta and cyan gradations are $\gamma_Y$, $\gamma_M$ and $\gamma_C$, respectively, and the change in yellow, magenta and cyan sensitivity in accordance with the change in exposure temperature are $\Delta S_Y$, $\Delta S_M$ and $\Delta S_C$, respectively, $\Delta CB_{YM}$, $\Delta CB_{MC}$ and $\Delta CB_{CY}$can be defined by the following equations:

$$\Delta CB_{YM} = |\Delta S_Y \times \gamma_Y - \Delta S_M \times \gamma_M| \text{ (absolute value)}$$

$$\Delta CB_{MC} = |\Delta S_M \times \gamma_M - \Delta S_C \times \gamma_C| \text{ (absolute value)}$$

$$\Delta CB_{CY} = |\Delta S_C \times \gamma_C - \Delta S_Y \times \gamma_Y| \text{ (absolute value)},$$

with the proviso that gradation- $\gamma_Y$ is the difference between $E_{Y,1.0}$ and $E_{Y,0.5}$ which are exposures (logarithm) required to obtain densities of 1.0 and 0.5 at 25° C. and 50% RH, respectively, and can be defined as follows ($\gamma_M$ and $\gamma_C$ are similarly defined):

$$\gamma_Y = (1.0-0.5)/(E_{Y,1.0} - E_{Y,0.5})$$

$$\gamma_M = (1.0-0.5)/(E_{M,1.0} - E_{M,0.5})$$

$$\gamma_C = (1.0-0.5)/(E_{C,1.0} - E_{C,0.5})$$

$\Delta S_Y$ is the difference between $S_{Y,30}$ and $S_{Y,15}$ which are sensitivities shown when exposed at 30° C. and 50% RH and at 15° C. and 50% RH, respectively, and can be defined as follows ($\Delta S_M$ and $\Delta S_C$ are similarly defined):

$$\Delta S_Y = S_{Y,30} - S_{Y,15}$$

$$\Delta S_M = S_{M,30} - S_{M,15}$$

$$\Delta S_C = S_{C,30} - S_{C,15}$$

The sensitivity as used herein is defined as the reciprocal of the exposure (logarithm) required to obtain a density of 0.75.

Preferably, in the heat-developable color light-sensitive material of the present invention, the compound which provides a dye (hereinafter referred to as a dye-providing compound) combined with the layer having a spectral sensitivity peak in the longest wavelength is a compound represented by the following formula (1):

$$[(Dye)_p X]_q Y \quad (1)$$

wherein Dye represents a dye group or dye precursor group represented by the following formula (2), Y represents a group which makes difference in diffusibility of the dye component in correspondence or reverse correspondence to a reduction reaction of light-sensitive silver halide having an imagewise latent image to silver; X represents a single bond or bonding group; p is an integer of 1 or more; and q is 1 or 2, with the proviso that when p is 2 or more, or when q is 2, the plurality of Dye's or $((Dye)_p—X)$'s may be the same or different:

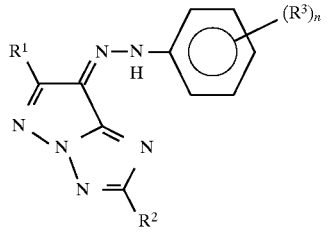

(2)

wherein $R^3$ represents a substituent selected from the group consisting of a halogen atom, hydroxyl group, cyano group, nitro group, carboxyl group, alkyl group, aralkyl group, cycloalkyl group, aryl group, heterocyclic group, alkoxy group, aryloxy group, amino group, acylamino group, sulfonylamino group, acyl group, sulfonyl group, carbamoyl group, sulfamoyl group, ureido group, alkylthio group and arylthio group; $R^1$ and $R^2$ each independently represents a hydrogen atom or the substituent defined in $R^3$, and $R^1$ and $R^2$ may be the same as or different from $R^3$; and n is an integer of 0 to 5, with the proviso that when n is from 2 to 5, the plurality of $R^3$'s may be the same or different; and Dye and X are bonded to each other at any one of $R^1$, $R^2$ and $R^3$.

The spectral sensitivity peak in the layers of the heat developable color light-sensitive material is within a wavelength range of 700 nm or more, preferably from 700 to 1,200 nm.

Dye-providing compounds often react with a silver ion to form a silver salt. Among dye-providing compounds, the dye-providing compounds having a structure represented by formula (2) of the present invention tend to have stronger interaction with a silver ion. Such an effect elevates the pAg of the light-sensitive material, thereby deteriorating exposure temperature dependency of the light-sensitive material, particularly, exposure temperature dependency of light-sensitive layer sensitized to infrared wavelength region. The present invention provides a method for solving the problems due to these disadvantages. In other words, high silver chloride emulsion of fine grains or easily soluble silver salt compounds for use in the present invention are added to the light-sensitive material in order to supply silver ions. These silver ions have an effect to react with dye-providing compounds, various antifogging agents or halogen ions contained in the light-sensitive material, thereby increasing the silver ion concentration in the layer of the light-sensitive material, i.e., reducing the pAg in the light-sensitive material.

The high silver chloride emulsion of fine grains for use in the present invention can be prepared in the same manner as in the preparation of the silver halide emulsion described later. However, it is preferable that chemical sensitization is not conducted, since the sensitivity increases or fog is easily occurred due to chemical sensitization. In order to actively reduce the sensitivity, the high silver chloride emulsion of fine grains may be doped with a heavy metal such as rhodium and iridium. Furthermore, for the purpose of preventing the change in size of the fine grain emulsion, the various antifogging agents such as those described in *Research Disclosure*, No. 17643, pp. 24–25, ibid., No. 18716, p. 649, right column and ibid., No. 307105, pp. 868–870 may be added. The silver chloride content is 80% or more, preferably 90% or more, by mol. The average size of the grains is preferably 0.15 $\mu$m less, more preferably from 0.01 to 0.10 $\mu$m.

Examples of the easily soluble silver salt compound include silver nitrate, silver fluoride, silver perchlorate, silver hexafluorophosphate(V) and potassium dicyanoargentate(I). Among these, silver nitrate and silver fluoride are preferred.

The amount added of the high silver chloride emulsion of fine grains or easily soluble silver salt compound is preferably from 5 mg/m$^2$ to 100 mg/m$^2$, more preferably from 10 mg/m$^2$ to 60 mg/m$^2$, in terms of silver.

The incorporation of the high silver chloride emulsion of fine grains or easily soluble silver salt compound are contained in at least one layer of the layer having a spectral sensitivity peak in the longest wavelength and the light-insensitive interlayer(s) adjacent thereto. As a result, an effect of minimizing fluctuations in the heat development and color balance fluctuations against the variation of temperature conditions during exposure can be provided. Such an effect is normally much more remarkable than expected. Such an effect is probably inherent to heat-developable color light-sensitive materials. The detailed principle of this effect is unknown at present. This effect is more remarkable in combination with the dye-providing compound represented by formula (1). Such a combined use of the above-described emulsion or easily soluble silver salt compound and the above-described dye-providing compound is preferred because the excellent properties of the dye-providing compound can be provided.

The compound represented by formula (1) for use in the present invention will be further described hereinafter.

Firstly, X will be further described.

X represents a single bond or bonding group. Examples of the bonding group represented by X include an alkylene group, substituted alkylene group, arylene group, substituted arylene group, heterocyclic group, —O—, —$SO_2$—, —CO—, —$NR^{14}$— (in which $R^{14}$ represents a hydrogen atom, alkyl group, aryl group or aralkyl group), and bonding groups formed by combining two or more of these groups.

Preferred examples of the bonding group represented by X include —$NR^{14}SO_2$—, —$NR^{14}CO$—, —O—, —$SO_2$—, and groups formed by combining these groups with substituted or unsubstituted alkylene group (e.g., methylene, ethylene, propylene) or arylene group (e.g., o-phenylene, m-phenylene, p-phenylene, 1,4-naphthylene).

If X has one or more substituents, preferred examples of the substituents include the following:

an alkyl group which may be substituted (e.g., methyl, trifluoromethyl, chloromethyl, dimethylaminomethyl, ethoxycarbonylmethyl, aminomethyl, acetylaminomethyl, ethyl, carboxyethyl, 3,3,3-trichloropropyl, n-propyl, iso-propyl, n-butyl, iso-butyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, t-octadecyl), aralkyl group which may be substituted (e.g., benzyl), alkenyl group which may be substituted (e.g., vinyl, allyl, 2-chlorovinyl, 1-methylvinyl, 2-cyanovinyl, cyclohexene-1-il), alkynyl group which may be substituted (e.g., ethynyl, 1-propenyl, 2-ethoxycarbonylethynyl), aryl group which may be substituted (e.g., phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl), heterocyclic group which may be substituted (e.g., 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzthiazolyl, 2-benzimidazolyl, 2-benzoxazolyl, 2-oxazoline-2-il, morpholino), acyl group which may be substituted (e.g., acetyl, propionyl, butyloyl, iso-butyloyl, 2,2-dimethylpropionyl, benzoyl, 3,4-dichlorobenzoyl, 3-acetylamino-4-methoxybenzoyl, 4-methylbenzoyl, 4-methoxy-3-sulfobenzoyl), sulfonyl group which may be substituted (e.g., methanesulfonyl, ethanesulfonyl, chloromethanesulfonyl, propanesulfonyl, butanesulfonyl, benzensulfonyl, 4-toluenesulfonyl), carbamoyl group which may be substituted (e.g., carbamoyl, methylcarbamoyl, dimethylcarbamoyl, bis-(2-methoxyethyl)carbamoyl, dimethylcarbamoyl, cyclohexylcarbamoyl), sulfamoyl group which may be substituted (e.g., sulfamoyl, methylsulfamoyl, dimethylsulfamoyl, diethylsulfamoyl, bis-(2-methoxyethyl) sulfamoyl, di-n-butylsulfamoyl, 3-ethoxypropylmethylsulfamoyl, N-phenyl-N-methylsulfamoyl), alkoxycarbonyl or aryloxycarbonyl group which may be substituted (e.g., methoxycarbonyl, ethoxycarbonyl, phenoxycarbonyl, 2-methoxyethoxycarbonyl), alkoxysulfonyl or aryloxysulfonyl group which may be substituted (e.g., methoxysulfonyl, ethoxysulfonyl, phenoxysulfonyl, 2-methoxyethoxysulfonyl), alkoxy or aryloxy group which may be substituted (e.g., methoxy, ethoxy, methoxyethoxy, 2-chloroethoxy, phenoxy, p-methoxyphenoxy), alkylthio or arylthio group which may be substituted (e.g., methylthio, ethylthio, n-butylthio, phenylthio, 4-chlorophenylthio, 2-methoxyphenylthio), amino group which may be substituted (e.g., amino, methylamino, N,N-dimethoxyethoxyamino, methylphenylamino), ammonio group which may be substituted (e.g., ammonio, trimethylammonio, phenyldimethylammonio, diemthylbenzylammonio), acylamino group which may be substituted (e.g., acetylamino, 2-carboxybenzoylamino, 3-nitrobenzoylamino, 3-diethylaminopropanoylamino, acryloylamino), acyloxy group which may be substituted (e.g., acetoxy, benzoyloxy, 2-butenoyloxy, 2-methylpropanoyloxy), sulfonylamino group which may be substituted (e.g., methanesulfonylamino, benzenesulfonylamino, 2-methoxy-5-n-methylbenzenesulfonylamino), alkoxycarbonylamino group which may be substituted (e.g., methoxycarbonylamino, 2-methoxyethoxycarbonylamino, isobutoxycarbonylamino, benzyloxycarbonylamino, t-butoxycarbonylamino, 2-cyanoethoxycarbonylamino), aryloxycarbonylamino group which may be substituted (e.g., phenoxycarbonylamino, 2,4-nitrophenoxycarbonylamino), alkoxycarbonyloxy group which may be substituted (e.g., methoxycarbonyloxy, t-butoxycarbonyloxy, 2-benzenesulfonylethoxycarbonyloxy, benzylcarbonyloxy), aryloxycarbonyloxy group which may be substituted (e.g., phenoxycarbonyloxy, 3-cyanophenoxycarbonyloxy, 4-acetoxyphenoxycarbonyloxy, 4-t-butoxycarbonylaminophenoxycarbonyloxy), aminocarbonylamino group which may be substituted (e.g., methylaminocarbonylamino, morpholinocarbonylamino, N-ethyl-N-phenylaminocarbonylamino, 4-methanesulfonylaminocarbonylamino), aminocarbonyloxy group which may be substituted (e.g., dimethylaminocarbonyloxy, pyrrolidinocarbonyloxy, 4-dipropylaminophenylaminocarbonyloxy), aminosulfonylamino group which may be substituted (e.g., diethylaminosulfonylamino, di-n-butylaminosulfonylamino, phenylaminosulfonylamino), sulfonyloxy group which may be substituted (e.g., phenylsulfonyloxy, methanesulfonyloxy, chloromethanesulfonyloxy, 4-chlorophenylsulfonyloxy), carboxyl group, sulfo group, cyano group, nitro group, hydroxyl group, and halogen atom.

Among these, particularly preferred are alkoxy group, amino group, sulfamoyl group, sulfonylamino group, carboxyl group, sulfo group, and halogen atom.

These substituents may be used as substituents on other substituents described below in the present invention.

Y will be further described hereinafter. The following formulae will be described including X.

(1) Y includes a negative-working releaser which releases a photographically useful group in correspondence to development.

Examples of Y include a negative-working releaser which releases a photographically useful group from an oxidation product.

A preferred example thereof includes a compound represented by the following formula (Y-1):

(Y-1)

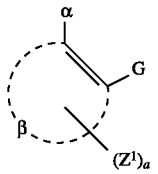

wherein β represents a nonmetallic atomic group necessary for forming a benzene ring, and the benzene ring may be condensed with a saturated or unsaturated carbon ring or heterocyclic ring; α- represents —$OZ^2$ or —$NHZ^3$, in which $Z^2$ represents a hydrogen atom or a group capable of producing a hydroxyl group by hydrolysis and $Z^3$ represents a hydrogen atom, alkyl group, aryl group or a group capable of producing an amino group by hydrolysis; $Z^1$ represents a halogen atom, cyano group, alkyl group, aryl group, aralkyl group, alkoxy group, alkylthio group, aryloxy group, arylthio-group, acyl group, sulfonyl group, acylamino group, sulfonylamino group, carbamoyl group, sulfamoyl group, ureido group, urethane group or heterocyclic group which each may have substituents; a is an integer of 1 or more, with the proviso that if a is 2 or more, the plurality of $Z^1$'s may be the same or different; —G represents —$NHSO_2X$; and X has the same meaning as defined in formula (1).

Preferred among groups represented by formula (Y-1) are those represented by the following formulae (Y-2) and (Y-3):

(Y-2)

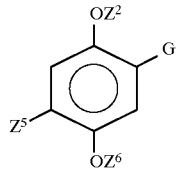

(Y-3)

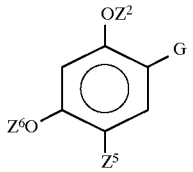

wherein $Z^2$ and G each has the same meaning as defined in formula (Y-1); and $Z^5$ and $Z^6$ each independently represents an alkyl group, aryl group or aralkyl group which each may have one or more substituents.

Preferably, $Z^5$ is a secondary or tertiary alkyl group, and the sum of the number of carbon atoms contained in $Z^5$ and $Z^6$ is from 20 to 50.

Specific examples of these groups represented by formulae (Y-2) and (Y-3) are described in U.S. Pat. Nos. 4,055,428 and 4,336,322, JP-A-51-113624, JP-A-56-16131, JP-A-56-71061, JP-A-56-71060, JP-A-56-71072, JP-A-56-73057, JP-A-57-650, JP-A-57-4043, JP-A-59-60439, JP-B-56-17656 (the term "JP-B" as used herein means an "examined Japanese patent publication") and JP-B-60-25780.

Another example of Y is (Y-4):

(Y-4)

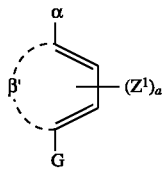

wherein α, G, $Z^1$ and a have the same meaning as defined in formula (Y-1), respectively; β' represents a nonmetallic atomic group necessary for forming a benzene ring, and the benzene ring may be condensed with a saturated or unsaturated carbon ring or heterocyclic ring.

Preferably, in formula (Y-4), α is —$OZ^2$, and β' forms a naphthalene skeleton. Specific examples thereof are described in U.S. Pat. Nos. 3,928,312 and 4,135,929.

Examples of releaser which releases a photographically useful group in the similar reaction as in (Y-1) and (Y-2) to include those described in JP-A-51-104343, JP-A-53-46730, JP-A-54-130122, JP-A-57-85055, JP-A-53-3819, JP-A-54-48534, JP-A-49-64436, JP-A-57-20735, JP-B-48-32129, JP-B-48-39165, and U.S. Pat. No. 3,443,934.

Examples of the compound which releases a photographically useful group from an oxidation product by another mechanism include hydroquinone derivatives represented by the following formulae (Y-5) and (Y-6):

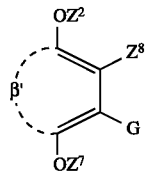

(Y-5)

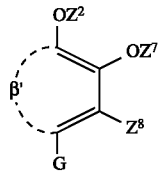

(Y-6)

wherein β' has the same meaning as defined in formula (Y-4); G and $Z^2$ have the meaning as defined in formula (Y-1), respectively; $Z^7$ has the same meaning as $Z^2$; $Z^8$ represents a hydrogen atom or the same substituent as defined with reference to $Z^1$; and $Z^7$ and $Z^8$ may be the same or different. Specific examples thereof are described in U.S. Pat. No. 3,725,062.

These hydroquinone derivative releasers may have a nucleophilic group in their molecules. Specific examples thereof are described in JP-A-4-97347.

Still further examples of Y include p-hydroxydiphenylamine derivatives as described in U.S. Pat. No. 3,443,939, and hydrazine derivatives as described in U.S. Pat. Nos. 3,844,785 and 4,684,604, and *Research Disclosure* (*R.D.*) No. 128, page 22.

Further examples of the negative-working releaser include a compound represented by the following formula (Y-7):

Coup-G (Y-7)

wherein Coup represents a group capable of coupling with an oxidation product of p-phenylenediamine or p-aminophenol, i.e., group known as a photographic coupler. Specific examples thereof are described in British Patent 1,330,524.

(2) Furthermore, examples of Y include a positive-working releaser which releases a photographically useful group in counter correspondence to development.

Examples of the positive-working releaser include a releaser which reveals its function by reduction during processing. Preferred examples thereof include the following formula (Y-8):

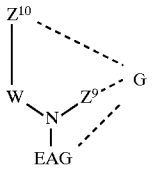

(Y-8)

wherein EAG represents a group which receives an electron from a reducing substance; N represents a nitrogen atom; W represents an oxygen atom, sulfur atom or —$NZ^{11}$—, and, after EAG receives electron, N—W bond is cleaved; $Z^{11}$ represents an alkyl or aryl group; and $Z^9$ and $Z^{10}$ each represent a single bond or a monovalent or divalent substituent other than a hydrogen atom, provided that the solid line represents a bond, and the broken lines indicate that at least one of these broken lines is bonded with each other.

A preferred example of the group represented by formula (Y-8) includes the following formula (Y-9):

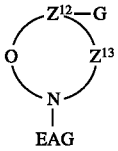

(Y-9)

wherein O represents an oxygen atom (in other words, W in (Y-8) is an oxygen atom); $Z^{12}$ represents an atomic group capable of forming a heterocyclic ring containing N—O bond and cleaving $Z^{12}$—G bond after cleaving the N—O bond, and $Z^{12}$ may have one or more substituents, and may be condensed with a saturated or unsaturated ring; and $Z^{13}$ represents —CO— or —$SO_2$—.

A preferred example of the group represented by formula (Y-9) include the following formula (Y-10):

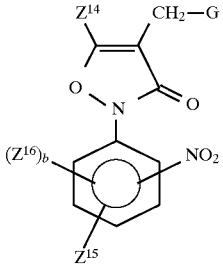

(Y-10)

wherein $Z^{14}$ represents an alkyl group, aryl group or aralkyl group; $Z^{15}$ represents a carbamoyl group or sulfamoyl group; $Z^{16}$ represents an alkyl, aryl group, aralkyl group, alkoxy group, alkylthio group, aryloxy group, arylthio group, halogen atom, cyano group or nitro group; and b is an integer of 0 to 3. Also, in formula (Y-10), the nitro group is substituted at an ortho- or para-position to the nitrogen atom.

More preferably, $Z^{15}$ is a $C_{12-30}$ carbamoyl group or sulfamoyl group substituted with an alkyl group.

Specific examples thereof are described in JP-A-62-215270, and U.S. Pat. No. 4,783,396.

Other examples of the positive-working releaser which reveals its function include BEND compounds as described in U.S. Pat. Nos. 4,139,379 and 4,139,389, Carquin compounds as described in British Patent 11,445, and releasers as described in JP-A-54-126535 and JP-A-57-84453.

The reducible releaser represented by Y such as (Y-8) is used in combination with a reducing agent. Alternatively, an LDA compound comprising a reducing group incorporated in its molecule may be used. The LDA compound is further described in U.S. Pat. No. 4,551,423.

Furthermore, the positive-working releaser includes releasers which are contained in a light-sensitive material as a reducing product, and are inactivated by oxidization during processing.

Examples thereof include Fields compounds as described in JP-A-51-63618 and U.S. Pat. No. 3,980,479, and Hinshaw compounds as described in JP-A-49-111628, JP-A-52-4819, and U.S. Pat. No. 4,199,354.

Another example of Y includes the following formula (Y-11):

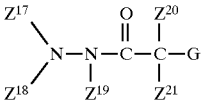

(Y-11)

wherein $Z^{17}$ and $Z^{19}$ each independently represents a hydrogen atom, an acyl, alkoxycarbonyl or aryloxycarbonyl group which may be substituted; $Z^{18}$ represents an alkyl, aryl, aralkyl, acyl, alkoxycarbonyl, aryloxycarbonyl, carbamoyl, sulfonyl or sulfamoyl group which may be substituted; and $Z^{20}$ and $Z^{21}$ each independently represents a hydrogen atom or an alkyl, aryl or aralkyl group which may be substituted. Specific examples thereof are described in JP-A-62-245270 and JP-A-63-46450.

A still further mechanism of positive-working releaser is given by a thiazolidine type releaser. The thiazolidine type releaser is described in, e.g., U.S. Pat. No. 4,468,451.

Whatever Y is used as a releaser, Y preferably has at least one ballast group having 10 or more carbon atoms.

In the present invention, the compound represented by formula (1) can exert its effect more remarkably when it comprises a negative-working releaser.

The dye moiety represented by formula (2) will be further described hereinafter.

In formula (2), $R^3$ represents a halogen atom, a hydroxyl group, cyano group, nitro group, carboxyl group, or a substituted or unsubstituted alkyl, aralkyl, cycloalkyl, aryl, heterocyclic, alkoxy, aryloxy, amino, acylamino, sulfonylamino, acyl, sulfonyl, carbamoyl, sulfamoyl, ureido, alkylthio or arylthio group. $R^1$ and $R^2$ each independently represent a hydrogen atom or a substituent as defined by $R^3$. n represents an integer of 0 to 5. When n is from 2 to 5, the plurality of $R^3$'s may be the same or different.

Dye and X are bonded to each other at any one of $R^1$, $R^2$ and $R^3$.

Preferred examples of $R^1$ include a substituted or unsubstituted alkyl group having from 1 to 4 carbon atoms (e.g., methyl, isopropyl, t-butyl, methoxyethyl, β-cyanoethyl, trifluoromethyl), substituted or unsubstituted alkoxy group having from 1 to 4 carbon atoms (e.g., methoxy, ethoxy, methoxyethoxy), substituted or unsubstituted aryl group having from 6 to 8 carbon atoms (e.g., phenyl, p-methoxyphenyl, p-hydroxyphenyl), hydroxyl group, cyano group, carbamoyl group, and carboxyl group.

Preferred examples of $R^2$ include a substituted or unsubstituted alkyl group having from 1 to 8 carbon atoms (e.g., methyl, butyl, methoxyethyl, β-cyanoethyl, β-acetylaminoethyl, β-methanesulfonylaminoethyl), substituted or unsubstituted aryl group having from 6 to 8 carbon atoms (e.g., phenyl, p-methoxyphenyl, p-chlorophenyl), substituted or unsubstituted aralkyl group having from 7 to 12 carbon atoms (e.g., benzyl, β-phenetyl, p-methoxyphenetyl), substituted or unsubstituted alkoxy group having from 1 to 6 carbon atoms (e.g., methoxy, ethoxy, methoxyethoxy), acylamino group having from 2 to 8 carbon atoms (e.g., acetylamino, butyloylamino, pivaloylamino), and sulfonylamino having from 1 to 7 carbon atoms (e.g., methanesulfonylamino, benzenesulfonylamino).

Preferred examples of $R^3$ include a hydrogen atom, halogen atom, cyano group, carboxyl group, substituted or unsubstituted carbamoyl group having from 1 to 5 carbon atoms (e.g., carbamoyl, N-methylcarbamoyl, N,N-dimethylcarbamoyl), substituted or unsubstituted sulfamoyl group having from 0 to 4 carbon atoms (e.g., sulfamoyl, N-methylsulfamoyl, N,N-dimethylsulfamoyl), substituted or unsubstituted sulfonyl group having from 1 to 4 carbon atoms (e.g., methanesulfonyl, ethanesulfonyl), methyl group, methoxy group, and methoxyethoxy group.

Dye and X are bonded to each other at any one of $R^1$, $R^2$ and $R^3$, preferably $R^2$ or $R^3$.

Specific examples of the compound of the present invention will be given below, but the present invention should not be construed as being limited thereto.

1.

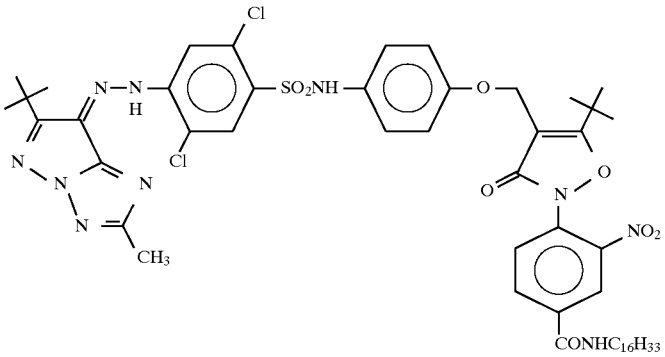

2.

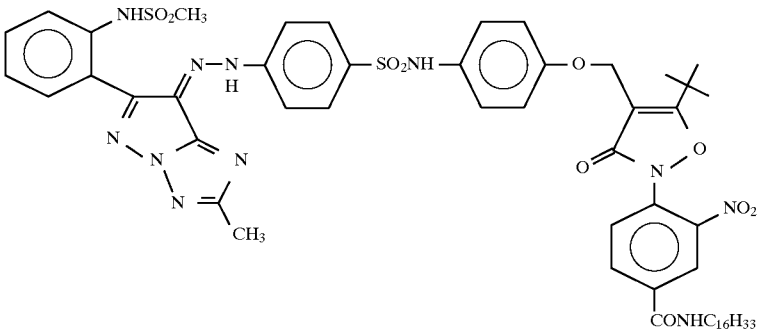

-continued
3.
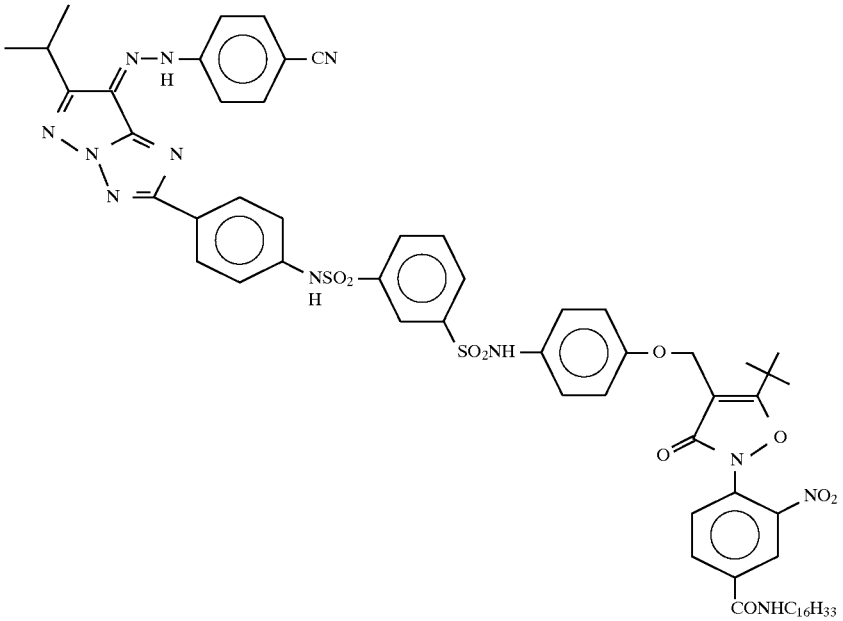
4.
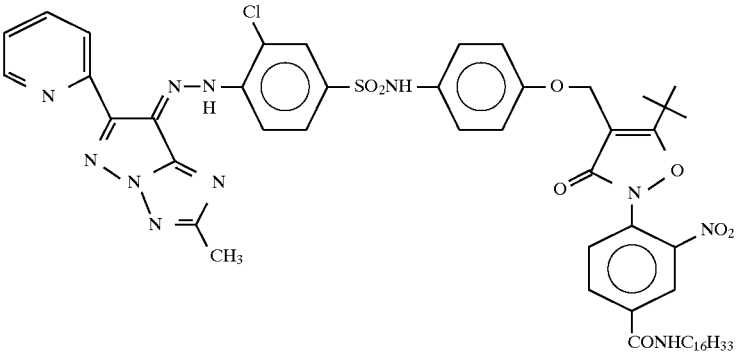
5.
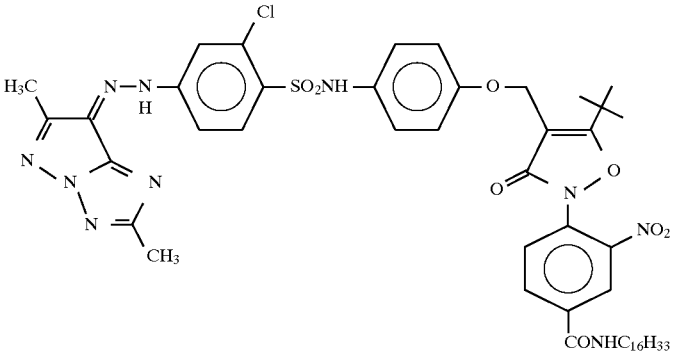

-continued
6.
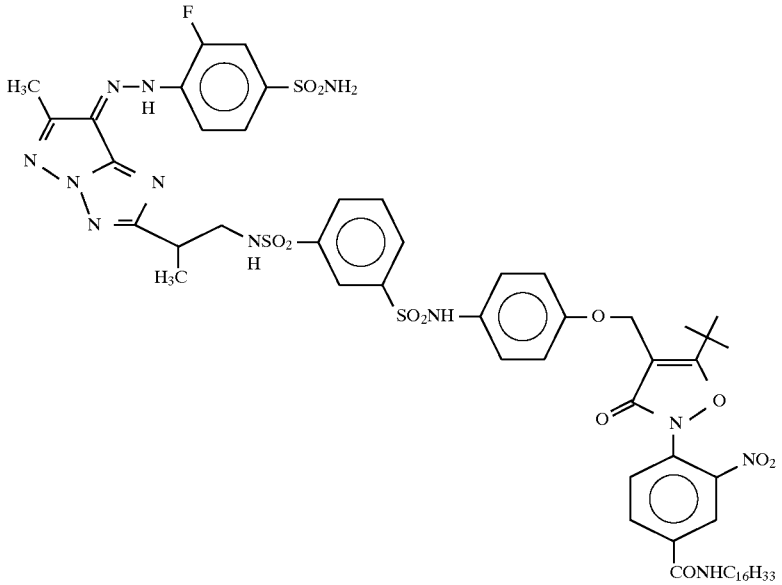
7.
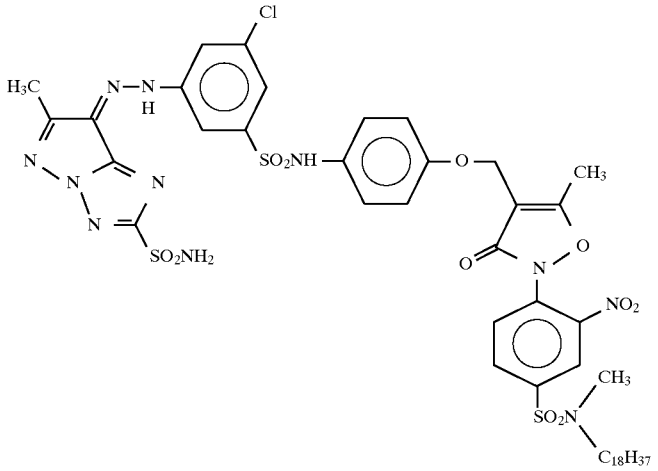
8.
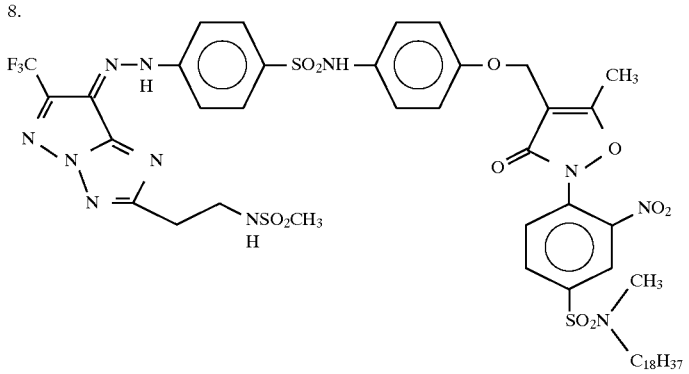

-continued
9.
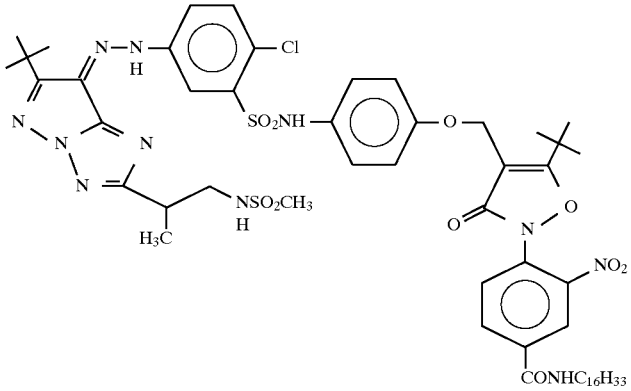
10.
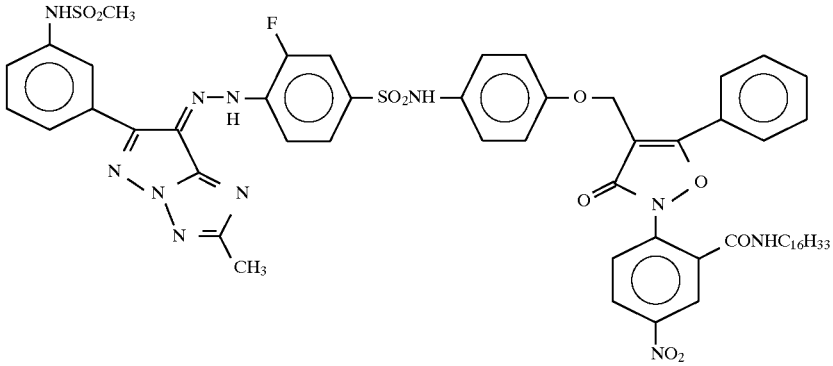
11.
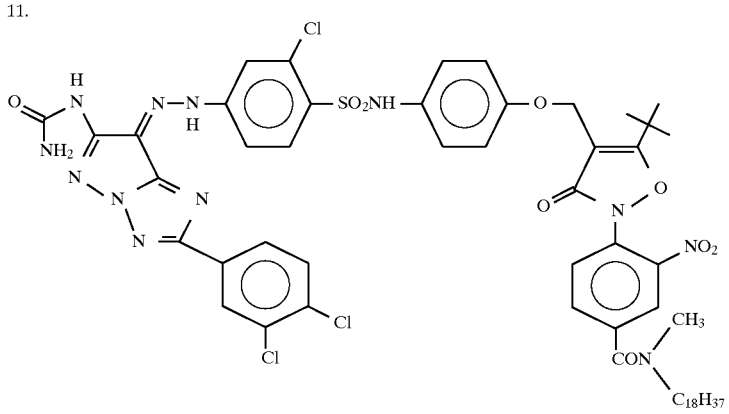

-continued
12.
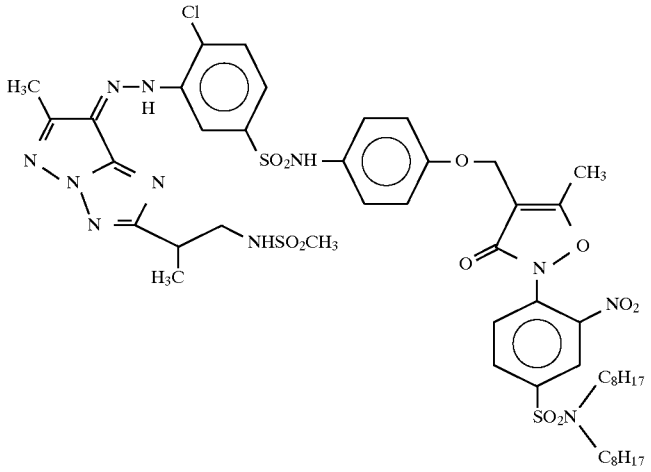
13.
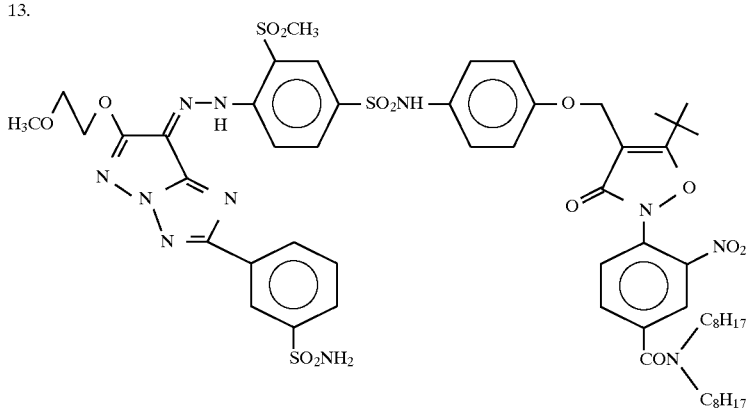
14.
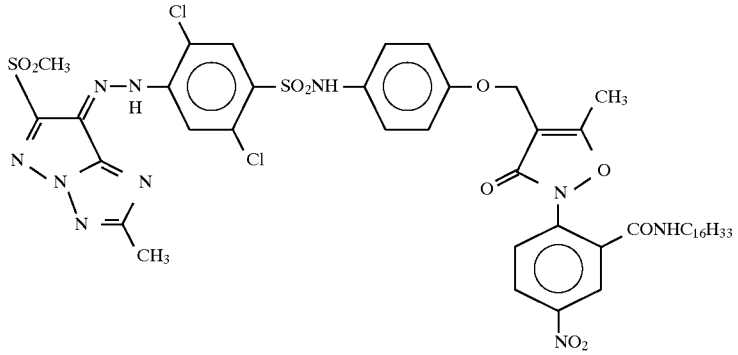

-continued
15.
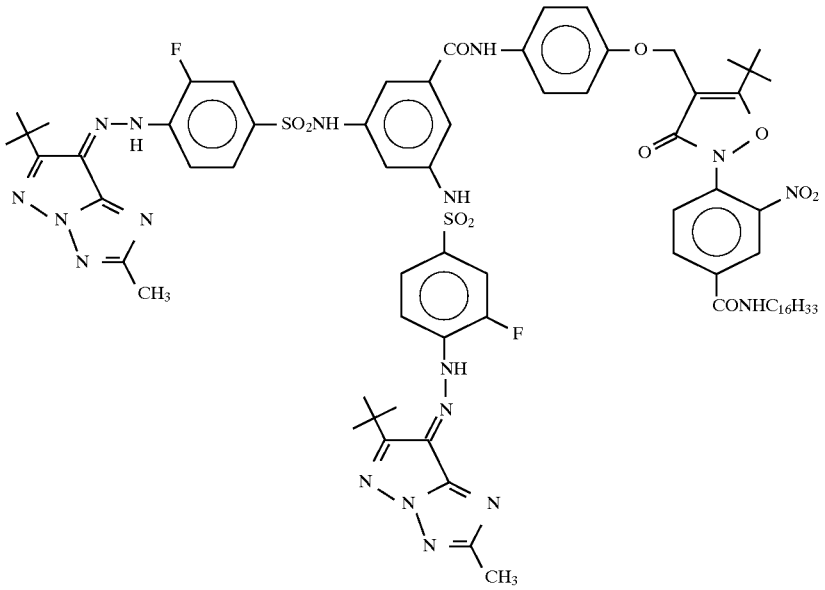
16.
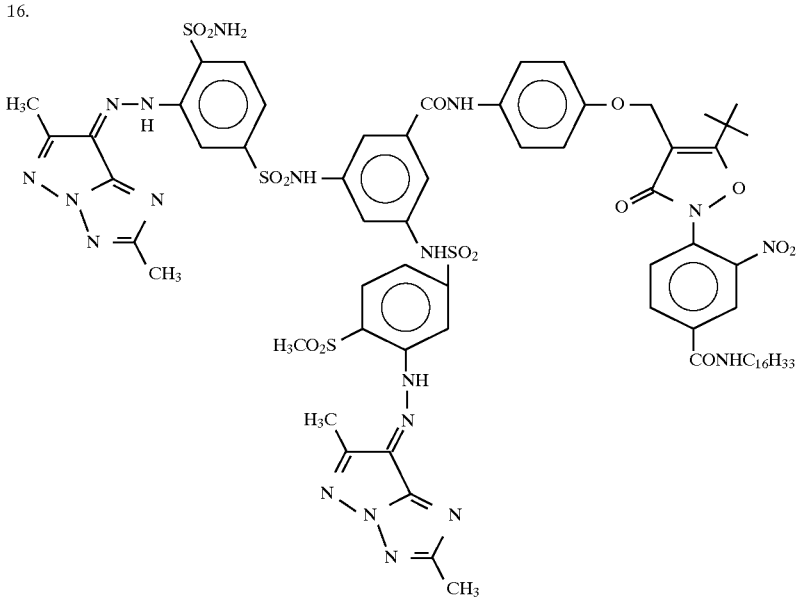

-continued
17.
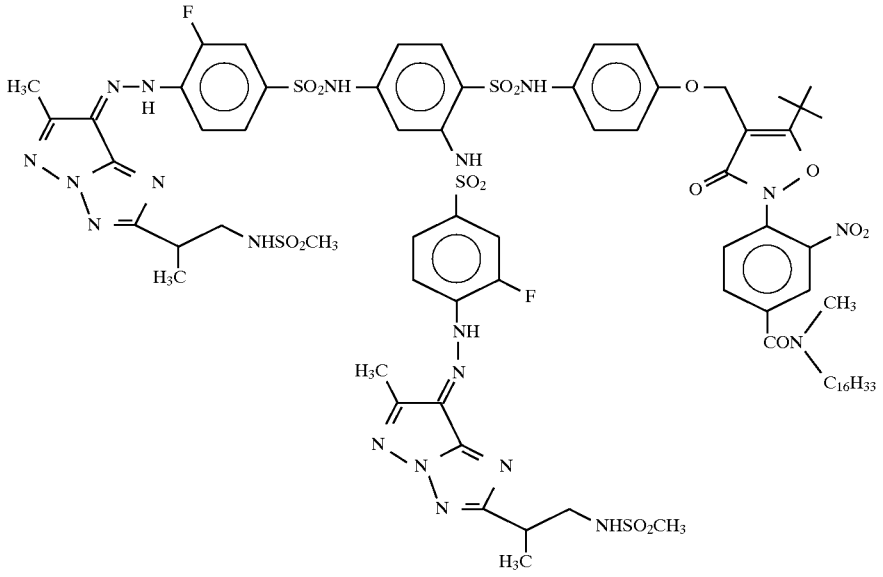
18.
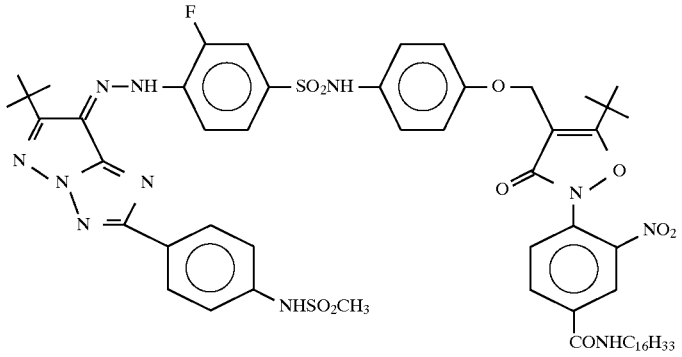

-continued
19.
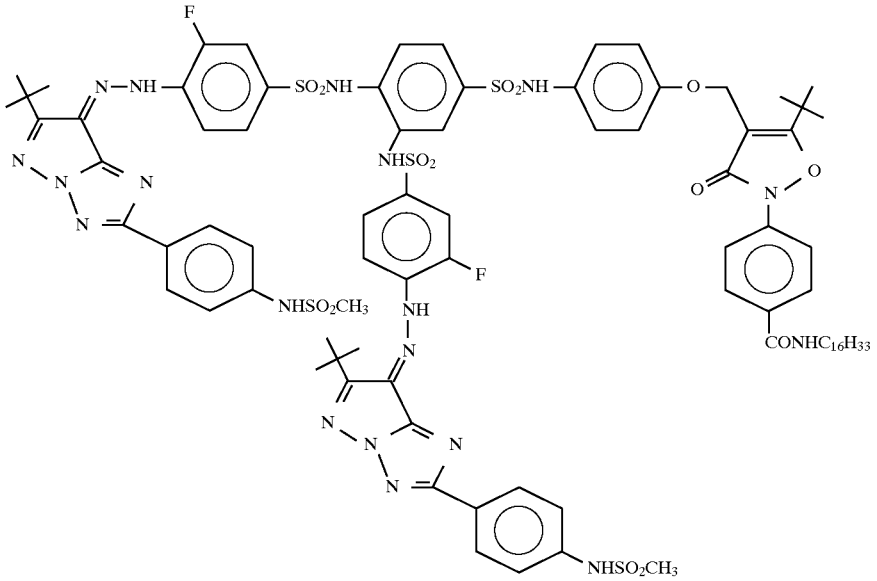
20.
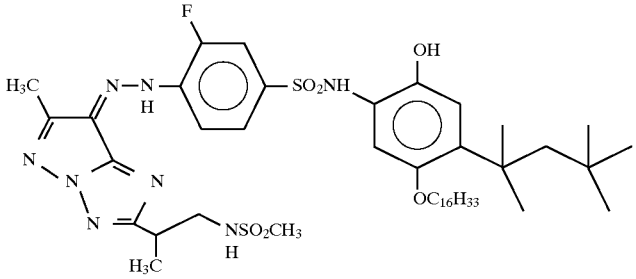
21.
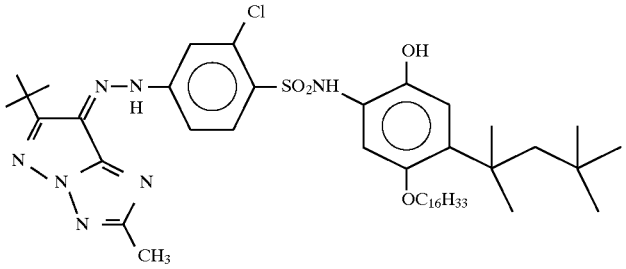
22.
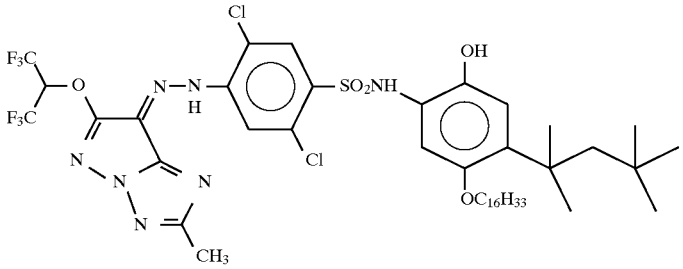

-continued
23.
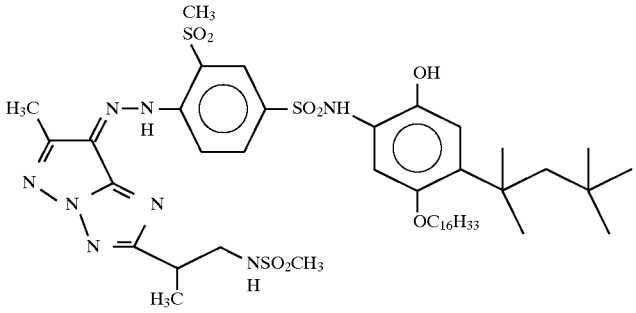
24.
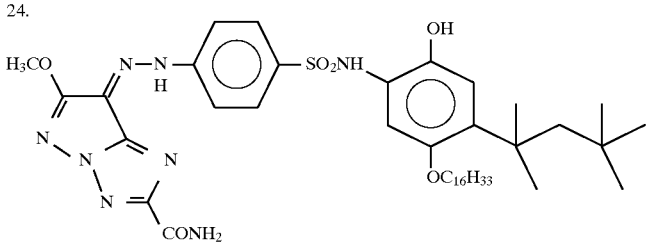
25.
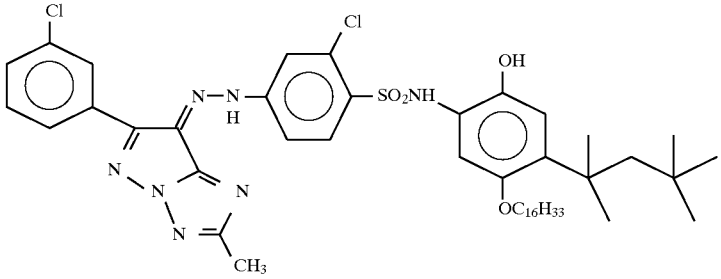
26.
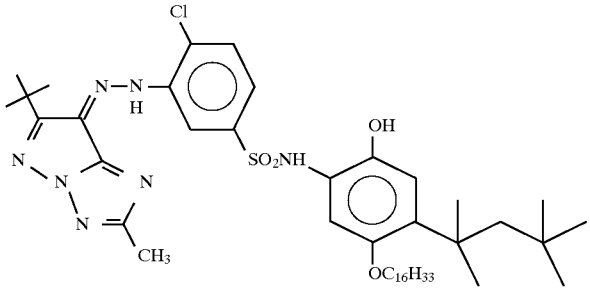

-continued
27.
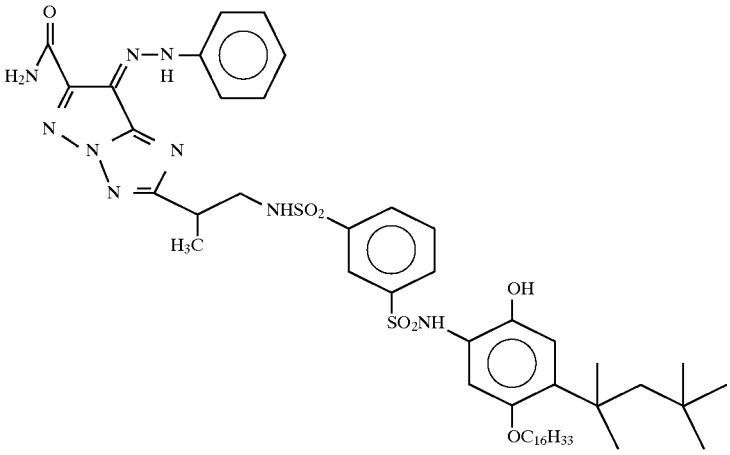
28.
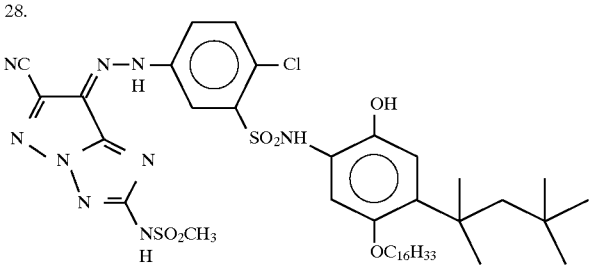
29.
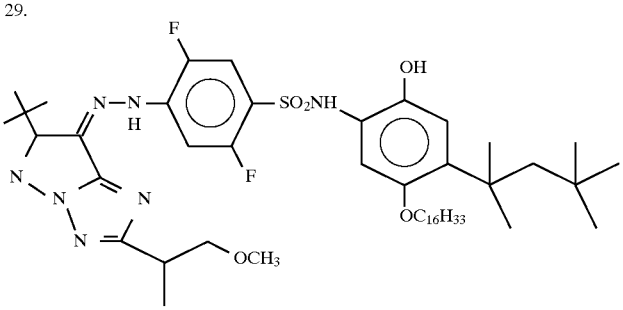
30.
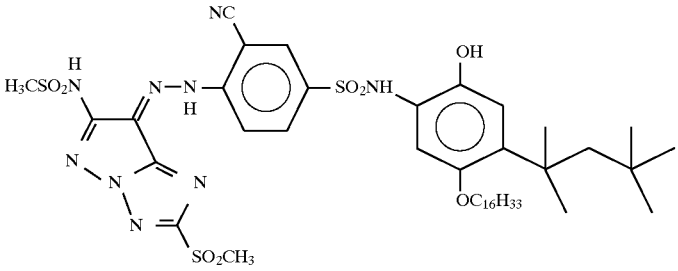

-continued
31.
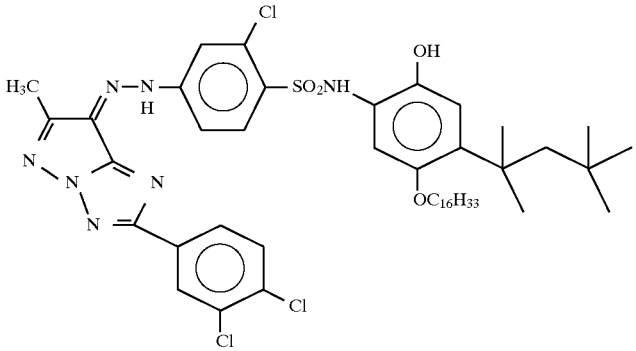
32.
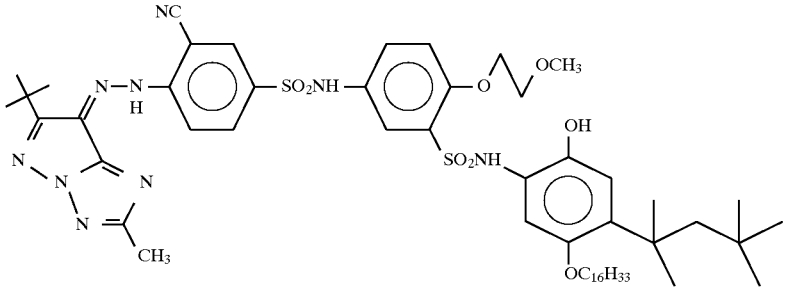
33.
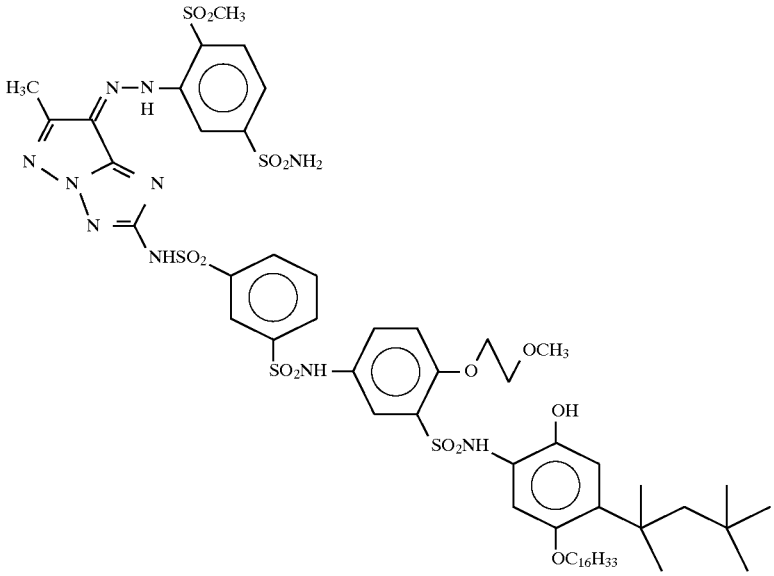
34.
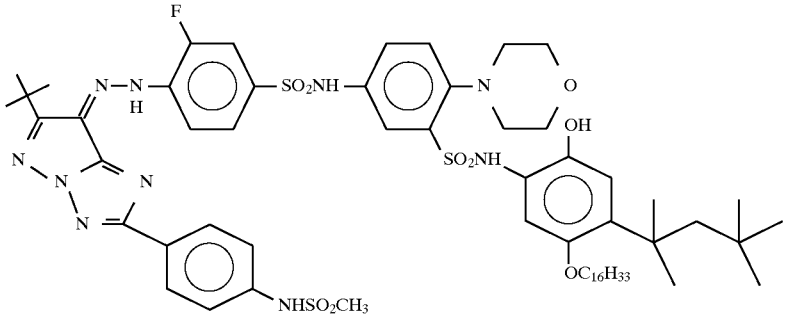

-continued
35.
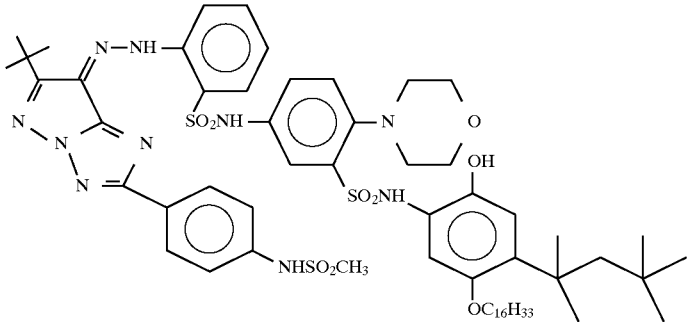
36.
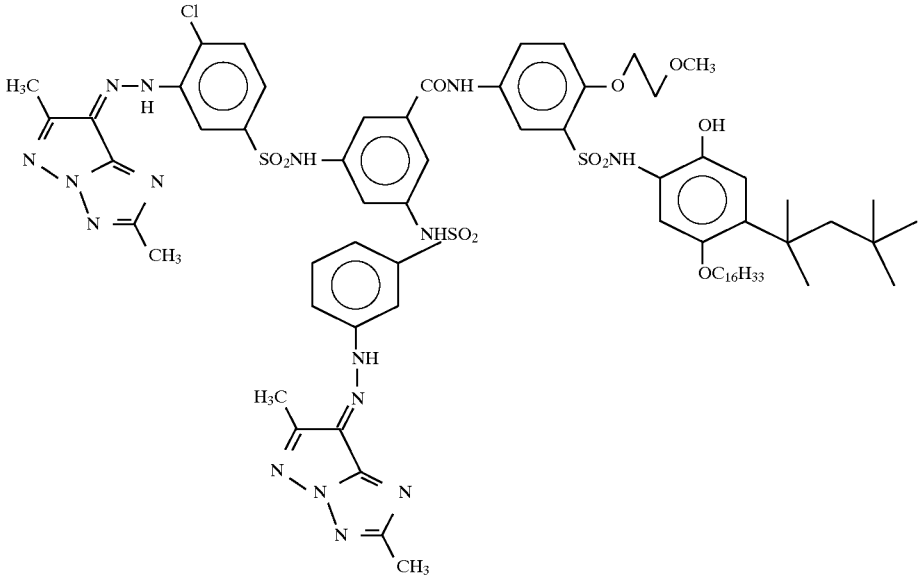
37.
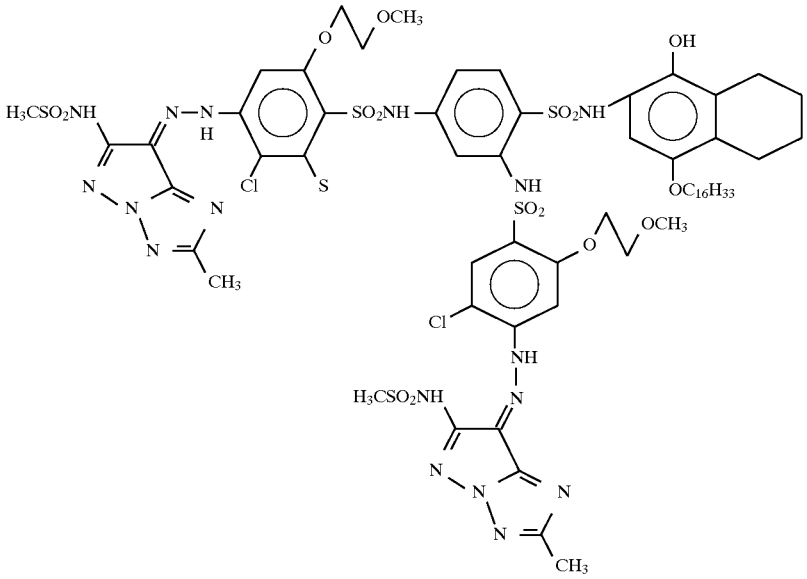

-continued

38.

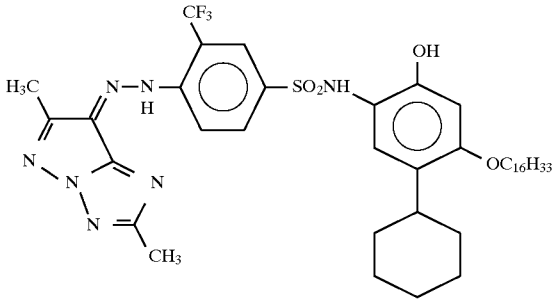

39.

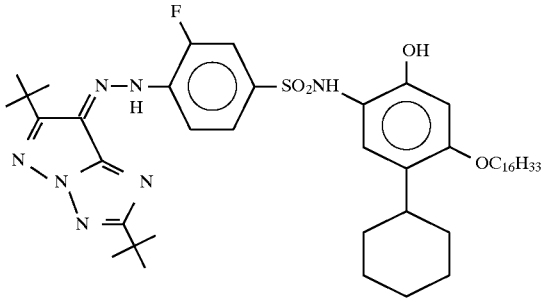

40.

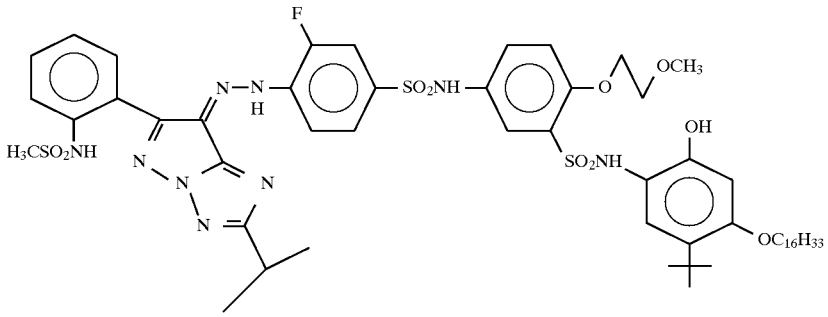

The synthesis of these compounds are described in, e.g., JP-A-6-301179.

In the present invention, the compound represented by formula (1) is preferably incorporated in the same layer as silver halide. In the present invention, the foregoing compound may be used in a wide range of amount, i.e., from 0.01 to 5 mol, preferably from 0.05 to 1 mol, per mol of silver.

The compound of the present invention is a yellow dye-providing compound. The compound of the present invention is used in combination with a magenta dye-providing compound and a cyan dye-providing compound to obtain a full-color image. Alternatively, the compound of the present invention may be used in combination with another yellow dye-providing compound. The dye-providing compound used in combination with the compound of the present invention is represented by the following formula (4):

$$[(\text{Dye}')_i\text{—}X']_j\text{—}Y' \qquad (4)$$

wherein Dye' represents a dye (particularly magenta or cyan) or dye precursor; Y' represents a group which makes difference in diffusibility of the dye component in correspondence to or in counter correspondence to a reduction reaction of light-sensitive silver halide having an imagewise latent image to silver between before and after the reaction reduction (i.e., the same meaning as Y); X' represents a single bond or bonding group (i.e., the same meaning as X); i is an integer of 1 or more; and j is 1 or 2, with the proviso that when i is 2 or more or when j is 2, the plurality of (Dye')'s or $((\text{Dye}')_i\text{—}X)$'s may be the same or different.

The heat-developable light-sensitive material according to the present invention essentially comprises light-sensitive silver halide, a binder, and optionally an organic metal salt oxidizer, a dye-providing compound (the reducing agent may serve also as a dye-providing compound as mentioned later) on a support.

These components are often incorporated in the same layer but may be separately incorporated in various layers if they are reactive with each other. For example, if a colored dye-providing compound is present in layers under the silver halide emulsion layer; it can inhibit the sensitivity drop. The reducing agent is preferably incorporated in the heat-developable light-sensitive material but may be externally supplied, e.g., by diffusing the reducing agent from the dye-fixing material as mentioned later.

In order to obtain a wide range of colors in the chromaticity diagram from the subtractive primaries, i.e., yellow, magenta and cyan, at least three silver halide emulsion layers having light-sensitivity in different spectral ranges are used in combination. For example, a combination of a blue-sensitive layer, a green-sensitive layer and a red-sensitive layer, a combination of a green-sensitive layer, a red-sensitive layer and an infrared-sensitive layer, and a combination of a red-sensitive layer, an infrared-sensitive layer (I) and an infrared-sensitive layer (II) may be used as described in JP-A-59-180550, JP-A-64-13546, JP-A-62-253159, and EP-A-479167. These photosensitive layers may be arranged in various orders known in the field of the ordinary type color light-sensitive materials. These photosensitive layers may each be divided into two or more layers as described in JP-A-1-252954, if needed.

The heat developable light-sensitive material may be provided with various light-insensitive layers such as protective layer, undercoating layer, interlayer, yellow filter layer and antihalation layer between the foregoing silver halide emulsion layers and various auxiliary layers such as backing layer on the opposite side of the support. In some detail, a layer structure as disclosed in the above cited patents, an undercoating layer as disclosed in U.S. Pat. No. 5,051,335, an interlayer containing a solid pigment as disclosed in JP-A-1-167838 and JP-A-61-20943, an interlayer containing a reducing agent or DIR compound as disclosed in JP-A-1-120553, JP-A-5-34884 and JP-A-2-64634, an interlayer containing an electron transfer agent as disclosed in U.S. Pat. Nos. 5,017,454 and 5,139,919 and JP-A-2-235,044, and a protective layer containing a reducing agent as disclosed in JP-A-4-249245 may be provided singly or in combination.

If the support is a polyethylene-laminated paper containing a white pigment such as titanium oxide, the back layer is preferably designed to exert an antistatic effect and exhibit a surface resistivity of $10^{12}$ Ω·cm or less.

The silver halide for use in the present invention may be any of silver chloride, silver bromide, silver bromoiodide, silver bromochloride, silver chloroiodide and silver bromochloroiodide.

The silver halide emulsion for use in the present invention may be a surface latent image type emulsion or an internal latent image type emulsion. The internal latent image type emulsion may be used as a direct reversal emulsion in combination with a nucleating agent or light fogging agent. The silver halide emulsion to be used in the present invention may be a so-called core-shell emulsion differing from core to shell in phase or may have different silver halide compositions connected to each other via an epitaxial junction. The silver halide emulsion may be monodisperse or polydisperse. Monodisperse silver halide emulsions may be used in admixture to control gradation as disclosed in JP-A-1-167743 and JP-A-4-223463. The grain size of silver halide grains is preferably from 0.1 to 2 μm, more preferably from 0.2 to 1.5 μm. The crystal habit of silver halide grains may be any of regular crystal such as cube, octahedron and tetradecahedron, irregular crystal such as sphere and tablet having a high aspect ratio, crystal having a crystal defect such as twinning plane, composite thereof and other crystal forms.

Specifically, any of silver halide emulsions prepared by the method as disclosed in U.S. Pat. Nos. 4,500,626 (col. 50) and 4,628,021, *Research Disclosure* (hereinafter referred to as RD) Nos. 17029 (1978), 17643 (December 1978), pp. 22–23, 18716 (November 1979), page 648, and 307105 (November 1989), pp. 863–865, JP-A-62-253159, JP-A-64-13546, JP-A-2-236546 and JP-A-3-110555, P. Glafkides, *Chemie et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964) may be used.

In the process for preparing of the light-sensitive silver halide emulsion, desalting, i.e., removal of excess salts, is preferably conducted. For the desalting, noodle washing involving gelation of gelatin may be conducted. Alternatively, sedimentation method using an inorganic salt (e.g., sodium sulfate), anionic surface active agent or anionic polymer (e.g., sodium polystyrenesulfonate) comprising polyvalent anions or gelatin derivative (e.g., aliphatic acylated gelatin, aromatic acylated gelatin, aromatic carbamoylated gelatin) may be used. Among these, preferred is sedimentation method.

The light-sensitive silver halide emulsion for use in the present invention may comprise heavy metals such as iridium, rhodium, platinum, cadmium, zinc, thallium, lead, iron and osmium for various purposes. These compounds may be used singly or in combination. The amount thereof depends on the purpose but is normally about from $10^{-9}$ to $10^{-3}$ mol per mol of silver halide. Such a compound may be uniformly incorporated in grains or may be localized inside or on the surface of grains. In some detail, an emulsion as disclosed in JP-A-2-236542, JP-A-1-116637 and JP-A-5-181246 is preferably used.

In the step of forming the light-sensitive silver halide emulsion grains according to the present invention, as a silver halide solvent there may be used a thiocyanate, ammonia, 4-substituted thioether compound, organic thioether derivative as disclosed in JP-B-47-11386 or sulfur-containing compound as disclosed in JP-A-53-144319.

For other conditions, reference can be made to the above cited references, e.g., P. Glafkides, *Chemie et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964). In some detail, the emulsion can be prepared by any of the acid process, the neutral process, and the ammonia process. The reaction between a soluble silver salt and a soluble halogen salt can be carried out by any of a single jet process, a double jet process, and a combination thereof. The double jet process is preferably used to obtain a monodisperse emulsion.

A method in which grains are formed in the presence of excess silver ions (reverse mixing method) may be used. Further, a so-called controlled double jet process, in which a pAg value of a liquid phase in which silver halide grains are formed is maintained constant, may also be used.

The concentration, amount or addition rate of silver salts and halides may be raised to expedite the growth of grains (as disclosed in JP-A-55-142329, JP-A-55-158124, and U.S. Pat. No. 3,650,757).

The agitation of the reaction solution may be effected by any known agitation method. The temperature and pH of the reaction solution during the formation of silver halide grains may be arbitrarily predetermined depending on the purpose. The pH is preferably from 2.2 to 7.0, more preferably from 2.5 to 6.0.

In general, the light-sensitive silver halide emulsion is a chemically-sensitized silver halide emulsion. The chemical sensitization of the light-sensitive silver halide emulsion according to the present invention, if the emulsion is used for ordinary type light-sensitive materials, may be effected by chalcogen sensitization method such as sulfur sensitization method, selenium sensitization method and tellurium sensitization method, noble metal sensitization method using gold, platinum, or palladium, and reduction sensitization method, singly or in combination (as disclosed in JP-A-3-110555 and JP-A-5-241267). The chemical sensitization may be effected in the presence of a nitrogen-containing heterocyclic compound (as disclosed in JP-A-62-253159). An antifoggant as described later may be added after the completion of chemical sensitization. In some detail, a method as described in JP-A-5-45833 and JP-A-62-40446 may be used.

The pH value during the chemical sensitization is preferably from 5.3 to 10.5, more preferably from 5.5 to 8.5. The pAg value during the chemical sensitization is preferably from 6.0 to 10.5, more preferably 6.8 to 9.0.

The coated amount of the light-sensitive silver halide emulsion according to the present invention is from 1 $mg/m^2$ to 10 $g/m^2$ in terms of silver.

The light-sensitive silver halide emulsion according to the present invention is spectrally sensitized with a methine dye or the like to have color sensitivity for green, red or infrared. If necessary, the blue-sensitive emulsion may be spectrally sensitized at a blue range.

Examples of dyes for use in the spectral sensitization include cyanine dye, melocyanine dye, composite cyanine dye, composite melocyanine dye, holopolar cyanine dye, hemicyanine dye, styryl dye and hemioxonol dye.

Specifically, sensitizing dyes as disclosed in U.S. Pat. No. 4,617,257, JP-A-59-180550, JP-A-64-13546, JP-A-5-45828 and JP-A-5-45834 can be used.

These sensitizing dyes can be used singly or in combination. A combination of these sensitizing dyes is often used particularly for the purpose of wavelength adjustment in supersensitization or spectral sensitization.

Besides these sensitizing dyes, a dye which doesn't exert a spectral sensitizing effect itself or a compound which doesn't substantially absorb visible light but exerts a supersensitizing effect may be incorporated in the emulsion (as disclosed in U.S. Pat. No. 3,615,641, and JP-A-63-23145).

The time at which these sensitizing dyes are incorporated in the emulsion may be during or before or after the chemical ripening or may be before or after the nucleation of silver halide grains as disclosed in U.S. Pat. Nos. 4,183,756, and 4,225,666. These sensitizing dyes or supersensitizers may be added in the form of solution in an organic solvent such as methanol, dispersion in gelatin or solution in a surface active agent. The amount of these sensitizing dyes to be added is normally from $10^{-8}$ mol to $10^{-2}$ mol per mol of silver halide.

Additives which can be used in these processes and known light-sensitive additives which can be incorporated in the heat-developable light-sensitive material are also described in the above cited *RD* Nos. 17643, 18716 and 307105 as tabulated below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 648, RC | p. 868 |
| 5. Antifoggant, Stabilizer | pp. 24–25 | p. 649, RC | pp. 868–870 |
| 6. Light Absorbent, Filter Dye, Ultraviolet Absorbent | pp. 25–26 | p. 649, RC to P. 650, left column (LC) | p. 873 |
| 7. Dye Image Stabilizer | p. 25 | p. 650, LC | p. 872 |
| 8. Hardening Agent | p. 26 | p. 651, LC | pp. 874–875 |
| 9. Binder | p. 26 | " | pp. 873–874 |
| 10. Plasticizer, Lubricant | p. 27 | p. 650, RC | p. 876 |
| 11. Coating Aid, Surface Active Agent | pp. 26–27 | " | p. 875–876 |
| 12. Antistatic Agent | p. 27 | " | pp. 876–877 |
| 13. Matting Agent | | | pp. 878–879 |

The binder in the light-sensitive material or dye-fixing material is preferably hydrophilic. Examples thereof include those described in the above cited *RD*'s and JP-A-64-13546, pp. 71–75. Specifically, a transparent or semi-transparent hydrophilic binder is preferred. Examples thereof include proteins such as gelatin and gelatin derivatives, natural compounds such as cellulose derivatives, starch, gum arabic, dextran, pullulan and other polysaccharides, and synthetic high molecular compounds such as polyvinyl alcohol, polyvinyl pyrrolidone and acrylamide. Further, a high water absorption polymer as disclosed in U.S. Pat. No. 4,960,681, and JP-A-62-245260, i.e., homopolymer of vinyl monomer having —COOM or —$SO_3M$ (in which M is a hydrogen atom or alkaline metal atom) or copolymer of such vinyl monomers or copolymer of such vinyl monomers with other vinyl monomers (e.g., sodium methacrylate, ammonium methacrylate, Sumikagel available from Sumitomo Chemical Co., Ltd.) may be used. Two or more of these binders may be used in combination. In particular, a combination of gelatin and the binders is preferred. Gelatin may be selected from the group consisting of lime-treated gelatin, acid-treated gelatin and delimed gelatin having a reduced content of calcium or the like depending on various purposes. These gelatins may be preferably used in combination.

In the system where heat development is effected with the supply of a slight amount of water, if the high water absorption polymer is used, water absorption can be rapidly effected. Further, if a high water absorption polymer is incorporated in the dye-fixing layer or its protective layer, the dyes can be prevented from being re-transferred from the dye-fixing element to other elements after transfer.

In the present invention, the amount of the binder is preferably 20 $g/m^2$ or less, more preferably 10 $g/m^2$ or less, and particularly preferably from 0.5 $g/m^2$ to 7 $g/m^2$.

In the present invention, the light-sensitive element may comprise an organic metal salt as an oxidizer in combination with the light-sensitive silver halide emulsion. Among these, organic silver salts are particularly preferred as organic metal salts.

Examples of organic compounds which can be used to form such an organic silver salt as an oxidizer include benzotriazoles, aliphatic acids and other compounds as disclosed in U.S. Pat. No. 4,500,626 (col. 52–53). Other useful examples of organic compounds include silver acetylene as described in U.S. Pat. No. 4,775,613. Two or more of these organic silver salts may be used in combination.

The above mentioned organic silver salt can be used in an amount of 0.01 to 10 mol, preferably 0.01 to 1 mol, per mol of light-sensitive silver halide. The sum of the coated amount of light-sensitive silver halide and organic silver salt is preferably from 0.05 $mg/m^2$ to 10 $g/m^2$, more preferably 0.1 $g/m^2$ to 4 $g/m^2$, in terms of silver.

The reducing agent for use in the present invention include those known in the field of light-sensitive material. Reducing dye-providing compounds as described later can also be used (in this case, other reducing agents may be used in combination therewith). Further, a reducer precursor which exhibits no reducing effect itself but exerts a reducing effect by a nucleophilic reagent or heat during development can be used.

Examples of reducing agents for use in the present invention include reducing agents and reducer precursors as disclosed in U.S. Pat. Nos. 4,500,626 (col. 49–50), 4,839,272, 4,330,617, 4,590,152, 5,017,454, and 5,139,919, JP-A-60-140335 (pp. 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pp. 40–57), JP-A-1-120553, and EP-A-220746 (pp. 78–96).

A combination of various reducing agents as disclosed in U.S. Pat. No. 3,039,869 can be used.

If a nondiffusible reducing agent is used, an electron transfer agent and/or electron transfer agent precursor can be optionally used in combination therewith to accelerate the migration of electrons between the nondiffusible reducing agent and the developable silver halide. In particular, those disclosed in U.S. Pat. No. 5,139,919, and EP-A-418743 are preferably used. Further, a method for stably incorporating the reducing agent to the layers as disclosed in JP-A-2-230143 and JP-A-2-235044 may be preferably used.

The electron transfer agent or precursor thereof can be selected from the above mentioned reducing agents or precursors thereof. The electron transfer agent or precursor thereof preferably exhibits a greater mobility than the nondiffusible reducing agent (electron donor). Particularly useful electron transfer agents are 1-phenyl-3-pyrazolidones or aminophenols.

The nondiffusible reducing agent (electron donor) to be used in combination with the electron transfer agent can be selected from compounds which don't migrate substantially in the layers constituting light-sensitive material in the above mentioned reducing agents. Preferred examples thereof include hydroquinones, sulfonamidephenols, sulfonamidenaphtholes, compounds described as electron donors in JP-A-53-110827 and U.S. Pat. Nos. 5,032,487, 5,026,634 and 4,839,272, and nondiffusible reducing dye-providing compounds as described later.

Further, an electron donor precursor as disclosed in JP-A-3-160443 may be preferably used.

Moreover, the interlayer and protective layer may comprise the reducing agents incorporated therein for various purposes such as prevention of color stain and improvement in color reproducibility. Specifically, reducing agents as disclosed in EP-A-524649, EP-A-357040, JP-A-4-249245, JP-A-2-46450 and JP-A-63-186240 are preferably used. Further, development inhibitor-releasing reducing compounds as disclosed in JP-B-3-63733, JP-A-1-150135, JP-A-2-64634, JP-A-3-43735, and EP-A-451833 may be used.

In the present invention, the total amount of the reducing agents to be incorporated is preferably from 0.01 to 20 mol, more preferably from 0.1 to 10 mol, per mol of silver.

In the present invention, silver may be used as an image-forming substance. Alternatively, the image-forming substance includes a compound which produces or releases a mobile dye in correspondence or counter correspondence to the reduction reaction of silver ion to silver at high temperature, i.e., dye-providing compound.

Examples of the dye-providing compounds for use in the present invention include compounds (couplers) which form a dye by an oxidative coupling reaction. These couplers may be two-equivalent or four-equivalent. Further, two-equivalent couplers containing a nondiffusible group as a separatable group which form a diffusible dye by an oxidative coupling reaction can be preferably used. These nondiffusible groups may form a polymer chain. Specific examples of color developing agents and couplers are further described in T. H. James, *The Theory of the Photographic Process*, 4th ed. (pp. 291–334 and pp. 354–361), *RD* No. 307105 (p. 871), JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Another example of dye-providing compound is a compound which serves to imagewise release or diffuse a diffusive dye. This type of a compound can be represented by the following formula [LI]:

$$((\mathrm{DYE})_s\mathrm{P})_t\mathrm{Q} \qquad [\mathrm{LI}]$$

wherein DYE represents a dye group or a dye group or dye precursor group which has been temporarily shifted to a short wavelength; Y represents a single bond or bonding group; Z represents a group which makes difference in diffusibility of the compound represented by $((\mathrm{DYE})_s\mathrm{P})_t\mathrm{Q}$ or releases $(\mathrm{DYE})_s\mathrm{P}$ to make difference in diffusibility from $((\mathrm{DYE})_s\mathrm{P})_t\mathrm{Q}$ in correspondence or counter correspondence to a light-sensitive silver salt having an imagewise latent image; s is an integer 1 to 5; and t is 1 or 2, with the proviso that when either s or t is not 1, the plurality of DYE's may be the same or different.

Specific examples of the dye-providing compound represented by formula [LI] include the following compounds (1) to (5). The compounds (1) to (3) form a diffusive dye image (positive dye image) in counter correspondence to the development of silver halide. The compounds (4) and (5) form a diffusive dye image (negative dye image) in correspondence to the development of silver halide.

(1) Dye developing agents in which a hydroquinone developing agent and a dye component are connected to each other can be used as disclosed in U.S. Pat. Nos. 3,134,764, 3,362,819, 3,597,200, 3,544,545, and 3,482,972, and JP-B-3-68387. These dye developing agents are diffusible under alkaline conditions but react with silver halide to become nondiffusible.

(2) As described in U.S. Pat. No. 4,503,137, nondiffusible compounds can be used which release a diffusible dye under alkaline conditions but react with silver halide to lose its capability. Examples of the nondiffusible compounds include compounds which release a diffusible dye by an intramolecular nucleophilic substitution reaction as disclosed in U.S. Pat. No. 3,980,479, and compounds which release a diffusible dye by an intramolecular rearrangement reaction of isooxazolone rings as disclosed in U.S. Pat. No. 4,199,354.

(3) As disclosed in U.S. Pat. Nos. 4,559,290, and 4,783,396, EP-A-220746, JIII Journal of Technical Disclosure 87-6199, and JP-A-64-13546, nondiffusible compounds can be used which react with a reducing agent left unoxidized upon development to release a diffusible dye.

Examples of the nondiffusible compounds include compounds which release a diffusible dye by an intramolecular nucleophilic substitution reaction after reduction as described in U.S. Pat. Nos. 4,139,389, and 4,139,379, and JP-A-59-185333 and JP-A-57-84453, compounds which release a diffusible dye by an intramolecular electron migration reaction after reduction as described in U.S. Pat. No. 4,232,107, JP-A-59-101649 and JP-A-61-88257, and *RD* No. 24025 (1984), compounds which release a diffusible dye by cleaving a single bond after reduction as described in West German Patent 3,008,588A, JP-A-56-142530 and U.S. Pat. Nos. 4,343,893 and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

Preferred examples of the nondiffusible compounds include compounds containing N—X bond (in which X represents oxygen, sulfur or nitrogen atom) and an electrophilic group per molecule as disclosed in EP-A-220746, JIII Journal of Technical Disclosure 87-6199, U.S. Pat. No. 4,783,396, JP-A-63-201653, JP-A-63-201654 and JP-A-64-13546, compounds containing $SO_2$—X bond (in which X has the meaning as defined above) and an electrophilic group per molecule as disclosed in JP-A-1-26842, and compounds containing C—X' bond (in which X' has the same meaning as X or represents —$SO_2$—) and an electrophilic group per molecule as disclosed in JP-A-63-271341. Compounds which release a diffusible dye by cleaving a single bond after reduction by π bond conjugated with electron accepting group as disclosed in JP-A-1-161237 and JP-A-1-161342 can also be used.

Among these, particularly preferred are compounds containing N—X bond and an electrophilic group per molecule. Specific examples thereof include Compounds (1) to (3), (7) to (10), (12), (13), (15), (23) to (26), (31), (32), (35), (36), (40), (41), (44), (53) to (59), and (70) as disclosed in EP-A-220746 or U.S. Pat. No. 4,783,396, Compounds (11) to (23) as disclosed in JIII Journal of Technical Disclosure 87-6199, and Compounds (1) to (84) as disclosed in JP-A-13546.

(4) Coupler compounds containing a diffusible dye as a separatable group which release a diffusible dye by a reaction with an oxidation product of a reducing agent (DDR couplers can be used). Specific examples thereof are described in British Patent 1,330,524, JP-B-48-39165, and U.S. Pat. Nos. 3,443,940, 4,474,867 and 4,483,914.

(5) Compounds capable of reducing silver halides or organic silver salts and release a diffusible dye by reducing the silver halides or organic silver salts (DRR compounds) can be used. These compounds don't require other reducing agents. Consequently, the compound is preferred because it is free from stain on the image with an oxidative decomposition product of reducing agents. Typical examples thereof are described in U.S. Pat. Nos. 3,928,312, 4,053,312, 4,055,428, 4,336,322, 3,725,062, 3,728,113, 3,443,939 and 4,500,626, JP-A-56-65839, JP-A-59-69839, JP-A-53-3819, JP-A-51-104343, JP-A-58-116537 and JP-A-57-179840, and *RD* No. 17465. Specific examples thereof include compounds as disclosed in U.S. Pat. No. 4,500,626 (col. 22–44). Among these, particularly preferred are Compounds (1) to (3), (10) to (13), (16) to (19), (28) to (30), (33) to (35), (38) to (40), and (42) to (64) disclosed in U.S. Pat. No. 4,500,626. Further, compounds as described in U.S. Pat. No. 4,639,408 (col. 37–39) are useful.

Examples of dye-providing compounds other than the above mentioned couplers and dye-providing compounds represented by formula [LI] include dye silver compounds in which an organic silver salt and a dye are connected to each other (*RD*, May 1978, pp. 54–58), azo dyes for use in heat development silver dye bleaching process (U.S. Pat. No. 4,235,957, *RD*, April 1976, pp. 30–32), and leuco dyes (U.S. Pat. Nos. 3,985,565 and 4,022,617).

Hydrophobic additives such as dye-providing compounds and nondiffusible reducing agents can be incorporated in the layers constituting the light-sensitive material according to any known method. In this case, a high boiling organic solvent as disclosed in U.S. Pat. Nos. 4,555,470, 4,536,466, 4,536,467, 4,587,206, 4,555,476 and 4,599,296, and JP-B-3-62256 can be used in combination with an organic solvent having a boiling point as low as 50° C. to 160° C., if necessary. Two or more of these dye-providing compounds, nondiffusible reducing agents and high boiling organic solvents may be used in combination.

The amount of the high boiling organic solvent is 10 g or less, preferably 5 g or less, and more preferably from 0.1 g to 1 g, per g of dye-providing compound used, and 1 ml or less, preferably 0.5 ml or less, more preferably 0.3 ml or less, per g of binder used.

Alternatively, a dispersion process with a polymer as described in JP-B-51-39853 and JP-A-51-59943 can be used.

A compound substantially insoluble in water can be finely dispersed in the binder rather than using the above mentioned methods.

When a hydrophobic compound is dispersed in a hydrophilic colloid, various colloids can be used. For example, compounds disclosed as surface active agents in JP-A-59-157636 (pp. 37–38) and the above cited *RD*'s can be used.

In the heat-developable light-sensitive material according to the present invention, a compound which activates development and stabilizes an image may be incorporated in the light-sensitive material. Preferable examples thereof are described in U.S. Pat. No. 4,500,626 (col. 51–52).

In the system wherein an image is formed by the diffusion transfer of a dye, various compounds may be incorporated in the layers constituting the heat-developable light-sensitive material for fixing or decoloring undesirable dyes or colored matters to improve the properties of the white background of the resulting image.

For example, compounds as disclosed in EP-A-353741, EP-A-461416, JP-A-63-163345 and JP-A-62-203158 may be used.

The layers constituting the heat-developable light-sensitive material according to the present invention can comprise various pigments or dyes incorporated therein for improving color separatability or raising sensitivity.

For example, compounds as disclosed in the above cited *RD*'s, and compounds and layer structures as disclosed in EP-A-479167, EP-A-502508, JP-A-1-167838, JP-A-4-343355, JP-A-2-168252 and JP-A-61-20943 may be used.

In the system where an image is formed by diffusing and transferring a dye, a dye-fixing element is used in combination with the heat-developable light-sensitive material. The dye-fixing element may be separately applied to a support different from that for the light-sensitive material or may be applied to the same support as the light-sensitive material. For the relationship between the light-sensitive material and the dye-fixing element, between the light-sensitive material and the support and between the light-sensitive material and the white reflective layer, those disclosed in U.S. Pat. No. 4,500,626 (col. 57) can apply to the present invention.

The dye-fixing element which can be preferably used in the present invention comprises at least one layer containing a mordant and a binder. As such a mordant there may be used one known in the art. Specific examples of such a mordant include mordants as disclosed in U.S. Pat. No. 4,500,626 (col. 58–59), JP-A-61-88255 (pp. 32–41) and JP-A-1-161236 (pp. 4–7), and mordants as disclosed in JP-A-62-244043 and JP-A-62-244036. Further, dye-accepting high molecular compounds as disclosed in U.S. Pat. No. 4,463,079 may be used.

As the binder to be incorporated in the dye-fixing element according to the present invention there may be preferably used the foregoing hydrophilic binder. Further, carrageenans as disclosed in EP-A-443529 may be preferably used as well.

The dye-fixing element may comprise auxiliary layers such as protective layer, peel layer and anticurling layer, if necessary. In particular, a protective layer is advantageously provided.

The layers constituting the heat-developable photographic light-sensitive material and dye fixing element can comprise a plasticizer, a lubricant or a high boiling organic solvent as an agent for improving the peelability between the light-sensitive material and the dye fixing element. Specific examples thereof include those described in the above cited *RD*'s and JP-A-62-245253.

Further, for the above mentioned purposes, various silicone oils (ranging from dimethyl silicone oil to modified silicone oils obtained-by incorporating various organic groups in dimethyl siloxane) can be used. Useful examples of such silicone oils are various modified silicone oils described in *Modified Silicone Oil* (technical report published by Shin-Etsu Silicone Co., Ltd.), page 6–18B, particularly carboxy-modified silicone (trade name: X-22-3710).

Further, silicone oils as disclosed in JP-A-62-215953 and JP-A-63-46449 can also be effectively used.

The heat-developable light-sensitive material or dye fixing element may comprise a discoloration inhibitor. Examples thereof include oxidation inhibitor, ultraviolet absorbent, and some kinds of metal complexes.

Examples of the oxidation inhibitor include chroman compounds, coumaran compounds, phenol compounds (e.g., hindered phenols), hydroquinone derivative, hindered amine derivative, and spiroindan compounds. Further, compounds as described in JP-A-61-159644 can also be effectively used as oxidation inhibitors.

Examples of the ultraviolet absorbents include benzotriazole compounds (U.S. Pat. No. 3,533,794), 4-thiazolidone compounds (U.S. Pat. No. 3,352,681), benzophenone compounds (JP-A-46-2784), and compounds (JP-A-54-48535, JP-A-62-136641, JP-A-61-88256). Further, ultraviolet-absorbing polymers as disclosed in JP-A-62-260152 can also be effectively used as ultraviolet absorbents.

Examples of the metal complexes include compounds as disclosed in U.S. Pat. Nos. 4,241,155, 4,245,018 (col. 3–36), and 4,254,195 (col. 3–8), and JP-A-62-174741, JP-A-61-88256 (pp. 27–29), JP-A-63-199248, JP-A-1-75568 and JP-A-1-74272.

The discoloration inhibitor for inhibiting the transfer of a dye which has been transferred to the dye fixing material may be previously incorporated in the dye fixing element or supplied into the dye fixing element externally, e.g., from the light-sensitive material.

The above mentioned oxidation inhibitors, ultraviolet absorbents and metal complexes may be used in combination.

The heat-developable light-sensitive material or dye fixing element may comprise a fluorescent brightening agent. In particular, the fluorescent brightening agent is preferably incorporated in the dye fixing element or supplied into the dye fixing element externally, e.g., from the light-sensitive material. Examples of the fluorescent brightening agent include compounds as disclosed in K. Veenkataraman, *The Chemistry of Synthetic Dyes*, vol. V, Chapter 8, and JP-A-61-143752. Specific examples of the fluorescent brightening agent include stilbene compounds, coumarine compounds, biphenyl compounds, benzoxazolyl compounds, naphthalimide compounds, pyrazoline compounds, and carbostyryl compounds.

The fluorescent brightening agent can be used in combination with a discoloration inhibitor or ultraviolet absorbent.

Specific examples of these discoloration inhibitors, ultraviolet absorbents and fluorescent brightening agents are disclosed in JP-A-62-215272 (pp. 125–137) and JP-A-1-161236 (pp. 17–43).

Examples of film hardeners to be incorporated in the layers constituting the heat-developable light-sensitive material or dye fixing element include those described in the above cited *RD*'s, U.S. Pat. Nos. 4,678,739 (col. 41), 4,791,042, JP-A-59-116655, JP-A-62-245261, JP-A-61-18942 and JP-A-4-218044. Specific examples of the film hardeners include aldehyde film hardeners (e.g., formaldehyde), aziridine film hardeners, epoxy film hardeners, vinylsulfone film hardeners (e.g., N,N'-ethylene-bis(vinylsulfonylacetamido) ethane), N-methylol film hardeners (e.g., dimethylolurea), and high molecular film hardeners (e.g., compounds as described in JP-A-62-234157).

The film hardener may be used in an amount of 0.001 g to 1 g, preferably 0.005 g to 0.5 g, per g of gelatin coated. Such a film hardener may be incorporated in any of the layers constituting the light-sensitive material or dye-fixing element or may be separately incorporated in two or more layers.

The layers constituting the heat-developable light-sensitive material or dye-fixing element may comprise various antifoggants or photographic stabilizers or precursors thereof. Specific examples of these compounds are disclosed in the above cited *RD*'s, U.S. Pat. Nos. 5,089,378, 4,500,627, 4,614,702, 4,775,610, 4,628,500, 4,983,494, JP-A-64-13546 (pp. 7–9, pp. 57–71, pp. 81–97), JP-A-62-174747, JP-A-62-239148, JP-A-1-150135, JP-A-2-110557, JP-A-2-178650, and *RD* No. 17,643 (1978, pp. 24–25).

These compounds are preferably used in an amount of $5\times10^{-6}$ to $1\times10^{-1}$ mol, more preferably $1\times10^{-5}$ to $1\times10^{-2}$ mol, per mol of silver.

The layers constituting the heat-developable light-sensitive material or dye fixing element can comprise various surface active agents for aiding coating, improving peelability and slip properties, inhibiting electrification, accelerating development or like purposes. Specific examples of the surface active agents are described in the above cited *RD*'s, JP-A-62-173463 and JP-A-62-183457.

The layers constituting the heat-developable light-sensitive material or dye fixing element can comprise an organic fluoro compound incorporated therein for improving slip properties and peelability, inhibiting electrification or like purposes. Representative examples of the organic fluoro compound include fluoro surface active agents as disclosed in JP-B-57-9053 (col. 8–17), JP-A-61-20944 and JP-A-62-135826, and hydrophobic fluorine compounds such as oil fluorinic compound (e.g., fluorine oil), and solid fluorine compound resin (e.g., ethylene tetrafluoride resin).

The heat-developable light-sensitive material or dye fixing element can comprise a matting agent. Examples of the matting agent include silicon dioxide, polyolefin and polymethacrylate as described in JP-A-61-88256 (p. 29), and benzoguanamine resin beads, polycarbonate resin beads and AS resin beads as described in JP-A-63-274944 and JP-A-63-274952. Further, compounds as disclosed in the above cited *RD*'s may be used.

In addition, the layers constituting the heat-developable photographic light-sensitive material and dye fixing element may comprise a heat solvent, an anti-foaming agent, a bactericide, a mildewproofing agent, a colloidal silica, etc. These additives are further described in JP-A-61-88256 (pp. 26–32), JP-A-3-11338 and JP-B-2-51496.

In the present invention, the heat-developable light-sensitive material and/or dye fixing element can comprise an image formation accelerator. The image formation accelerator serves to accelerate the redox reaction of a silver salt oxidizer and a reducing agent, accelerate reaction such as production or decomposition of a dye from a dye-providing substance and release of a diffusible dye from a dye-providing substance or accelerate the migration of a dye from the heat-developable light-sensitive material layer to the dye fixing layer. From the standpoint of physicochemical function, the image formation accelerator can be classified as base or base precursor, nucleophilic compound, high boiling organic solvent (oil), heat solvent, surface active agent, compound interacting with silver or silver ion, and the like. However, these substance groups normally have composite functions and exert some of these accelerating effects in combination. These image formation accelerators are further described in U.S. Pat. No. 4,678,739 (col. 38–40).

Examples of the base precursors include salts of organic acid and base which undergo decarboxylation on heating, and compounds which undergo intramolecular nucleophilic substitution reaction, Lossen rearrangement or Beckman rearrangement to release amines. Specific examples of the base precursors are disclosed in U.S. Pat. Nos. 4,514,493 and 4,657,848.

In the system where heat development and dye transfer are simultaneously effected in the presence of a small amount of water, a base and/or base precursor is preferably incorporated in the dye-fixing element to enhance the preservability of the heat-developable light-sensitive material.

In addition to the foregoing base precursors, a combination of a difficultly soluble metal compound and a compound capable of undergoing complexing reaction with metal ions constituting the difficultly soluble metal compound (i.e., complexing compound) as disclosed in EP-A-210660 and U.S. Pat. No. 4,740,445 and a compound which undergoes electrolysis to produce a base as disclosed in JP-A-61-232451 may be used as base precursors. In particular, the former is effective. The difficultly soluble metal compound and the complexing compound are advantageously incorporated separately in the heat-developable light-sensitive material and the dye-fixing element.

In the present invention, the heat-developable light-sensitive material and/or dye fixing element may comprise various development stop agents for the purpose of obtaining an invariably constant image quality against the fluctuation of processing temperature and time during development.

The development stop agent is a compound which rapidly neutralizes or reacts with a base after a proper development to reduce the base concentration in the film to stop development or a compound which interacts with silver or a silver salt after a proper development to inhibit development. Specific examples of the development stop agent include an acid precursor which releases an acid under heating, an electrophilic compound which undergoes substitution reaction with a base present therewith under heating, a nitrogen-containing heterocyclic compound, and a mercapto compound and precursor thereof. These compounds are further described in JP-A-62-253159 (pp. 31–32).

In the present invention, the support for the heat-developable light-sensitive material and dye fixing element is preferably a support material which can withstand the processing temperature. In general, photographic supports such as paper and synthetic high molecular compounds (film) as disclosed in *Shashin Kogaku no Kiso—Ginen Shashin hen* (*Base of Photographic Engineering—Silver Salt Photography Edition*), Society of Photographic Science and Technology of Japan, Corona Co., Ltd., 1979, pp. 223–240, are used. Examples of the support materials include polyethylene terephthalate, polyethylene naphthalate, polycarbonate, polyvinyl chloride, polystyrene, polypropylene, polyimide, cellulose (e.g., triacetyl cellulose), support materials obtained by incorporating a pigment such as titanium oxide in these films, paper obtained by film process synthesis of polypropylene, mixed paper made from a synthetic resin pulp such as polyethylene and a natural pulp, Yankee paper, baryta paper, coated paper (particularly cast coat paper), metal, cloth, and glass.

These support materials can be used directly or in the form of laminate with a synthetic high molecular compound such as polyethylene on one or both sides thereof.

Besides these support materials, support materials as disclosed in JP-A-62-253159 (pp. 29–31), JP-A-1-161236 (pp. 14–17), JP-A-63-316848, JP-A-2-22651, JP-A-3-56955 and U.S. Pat. No. 5,001,033 can be used.

Onto the surface of these support materials may be coated a hydrophilic binder, an oxide of semiconducting metal such as alumina sol and tin oxide, carbon black, and other antistatic agents.

Examples of methods for imagewise exposing the heat-developable light-sensitive material to record an image thereon include method which comprises directly photographing scene or persons using a camera or the like, method which comprises exposure through a reversal film or negative film using a printer or enlarger, method which comprises scanning exposure to an original image through a slit using an exposing apparatus in a copying machine, method which comprises exposure to light emitted by a light emitting diode or various lasers excited by an electrical signal representative of image data, and method which comprises exposure directly or through an optical system to image data outputted to an image display apparatus such as CRT, liquid crystal display, electroluminescence display and plasma display.

Examples of light sources for recording an image on the heat-developable light-sensitive material include natural light, tungsten lamp, light emitting diode, laser, CRT, and other light sources as described in U.S. Pat. No. 4,500,626, 56th column, JP-A-2-53378 and JP-A-2-54672.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds as described in JP-A-61-53462 and JP-A-62-210432. Examples of wavelength conversion elements include single crystal light guide type wavelength conversion element and fiber type wavelength conversion element. Any of these types of wavelength conversion elements can be effectively used.

Examples of the image data to which the present invention can be applied include image signal obtained from video camera or electronic still camera, television signal stipulated by National Television Signal Code (NTSC), image signal obtained by dividing an original image into many pixels by a scanner, and image signal produced by computers such as CG and CAD.

The heat-developable light-sensitive material and/or dye-fixing element according to the present invention may comprise an electrically conductive heating element layer as a heating means for heat development and diffusion transfer of dye. In this embodiment, heating element disclosed in JP-A-61-145544 can be used.

The heating temperature at the heat development process is normally from about 50° C. to 250° C., particularly about 60° C. to 180° C. The diffusion transfer of a dye may be effected at the same with or after the heat development process. In the latter case, the transfer of a dye can be effected at a heating temperature ranging from the heat development temperature to room temperature, particularly preferably 50° C. to a temperature about 10° C. lower than the heat development temperature.

The migration of a dye can be effected by heat alone. In order to accelerate the migration of a dye, a solvent may be used. As described in detail in U.S. Pat. Nos. 4,704,345, 4,740,445, and JP-A-61-238056, the system is preferably heated in the presence of a small amount of a solvent (particularly water) to simultaneously or continuously effect development and transfer. In this process, the heating temperature is preferably from 50° C. to a temperature lower than the boiling point of the solvent, e.g., from 50° C. to 100° C. if the solvent is water.

Examples of solvents for accelerating development and/or diffusing and transferring a dye to the dye fixing layer include water, and a basic aqueous solution containing an inorganic alkaline metal salt or organic base (these bases include those described with reference to the image formation accelerator). Further, a low boiling solvent, and a mixture of a low boiling solvent and water or the foregoing basic aqueous solution may be used. Moreover, a surface active agent, a fog inhibitor, a difficultly soluble metal salt, a complexing compound, a preservative, and a germicide, may be contained in these solvents.

Water is preferably used as the solvent employable in the heat development and diffusion transfer processes. The water may be any commonly used water. Specific examples of the water include distilled water, tap water, well water, and mineral water. In the heat developing apparatus for the heat-developable light-sensitive material and dye-fixing element according to the present invention, water may be used up or may be recycled. In the latter case, water exuding from the materials is reused. Further an apparatus and water as disclosed in JP-A-63-144354, JP-A-63-144355, JP-A-62-38460 and JP-A-3-210555 may be used.

These solvents may be provided to either or both of the heat-developable light-sensitive material and the dye fixing element. The amount of these solvents to be used may be not more than the weight thereof corresponding to the maximum swellable volume of the coated film.

Methods as disclosed in JP-A-62-253159 (page 5) and JP-A-63-85544 can be used for providing these solvents to the heat-developable light-sensitive layer or dye fixing layer. Alternatively, these solvents may be previously in either or both of the heat-developable light-sensitive material and the dye fixing element in the form of microcapsule or hydrate.

The temperature of water to be provided to these photographic materials may be from 30° C. to 60° C. as disclosed in JP-A-63-85544.

A hydrophilic heat solvent which stays solid at normal temperature but becomes soluble at an elevated temperature may be incorporated in the heat-developable light-sensitive material and/or dye fixing element for accelerating the migration of a dye. The layer in which the hydrophilic heat solvent is incorporated may be any of light-sensitive silver halide emulsion layer, interlayer, protective layer and dye fixing layer, preferably dye fixing layer and/or its adjacent layers.

Examples of the hydrophilic heat solvent include ureas, pyridines, amides, sulfonamides, imides, alcohols, oxims, and other heterocyclic groups.

Examples of the heating means at the development and/or transfer process include method which comprises bringing the material into contact with a heated block or plate, a hot plate, a hot presser, heat roller, halogen lamp heater, infrared lamp heater, or far infrared lamp heater, and method which comprises passing the material through a high temperature atmosphere.

A process described in JP-A-61-147244 (page 27) may be used as the process for the lamination of the heat-developable light-sensitive material and the dye-fixing element.

The processing of the photographic elements of the present invention can be accomplished by means of any of various heat development apparatus. For example, apparatus as described in JP-A-59-75247, JP-A-59-177547, JP-A-59-181353, JP-A-60-18951, JU-A-62-25944 (the term "JU-A" as used herein means a "published Japanese utility model application"), JP-A-6-95338 and JP-A-6-95267 may be preferably used. Examples of commercially available heat development apparatus for use in the present invention include Pictrostat 100, Pictrostat 200, Pictrography 3000, and Pictrography 2000 available from Fuji Photo Film Co., Ltd.

The present invention will be further described in the following examples, but the present invention should not be construed as being limited thereto. All parts, percents, ratios and the like are by weight unless otherwise indicated.

EXAMPLES

Example 1

The preparation of light-sensitive silver halide emulsions will be described hereinafter.

Liqht-sensitive silver halide emulsion (1) [emulsion for 5th layer (680 nm-sensitive layer)]

To an aqueous solution having the formulations set forth in Table 1 which had been thoroughly stirred were added simultaneously Solutions (I) and (II) having the formulations set forth in Table 2 in 13 minutes. After 10 minutes, to the mixture were added simultaneously Solutions (III) and (IV) having the formulations set forth in Table 2 in 33 minutes.

TABLE 1

| Composition | |
|---|---|
| $H_2O$ | 620 ml |
| Lime-treated gelatin | 20 g |
| KBr | 0.3 g |
| NaCl | 2 g |
| Silver halide solvent (1) | 0.030 g |
| Sulfuric acid (1N) | 16 ml |
| Temperature | 45° C. |

TABLE 2

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| Total amount (water to make) | 126 ml | 132 ml | 254 ml | 252 ml |

Silver halide solvent (1)

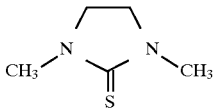

When 13 minutes passed after the addition of Solution (III) 150 ml of a 0.350% aqueous solution of the following sensitizing dye (a) was added to the mixture in 27 minutes.

The emulsion was then rinsed and desalted by an ordinary method (pH kept to 4.1 with a precipitant (a)). To the emulsion was then added 22 g of lime-treated osein gelatin so that it was adjusted to pH 6.0 and pAg 7.9. The emulsion was then chemically sensitized at a temperature of 60° C. with compounds set forth in Table 3. As a result, 630 g of a mondisperse emulsion of cubic silver bromochloride grains having a coefficient of variation of 10.2% and an average grain size of 0.20 μm was obtained.

Precipitating medium (a)

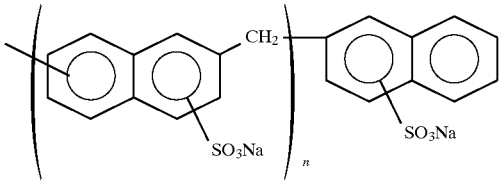

Precipitating medium (b)

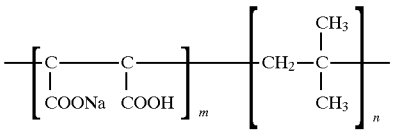

Sensitizing dye (a)

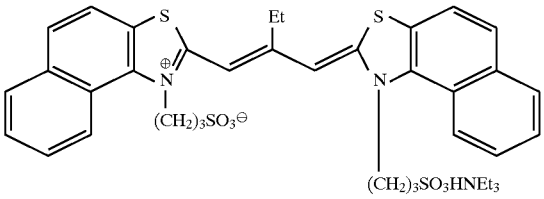

TABLE 3

| Composition used in chemical sensitization | Amount added |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| preservative (1) | 0.07 g |
| preservative (2) | 3.13 g |

Fog inhibitor (1)

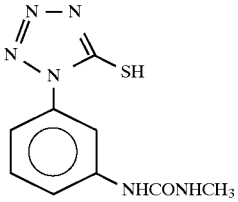

Preservative (1)

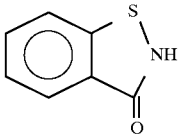

Preservative (2)

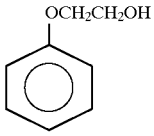

Preservative (3)

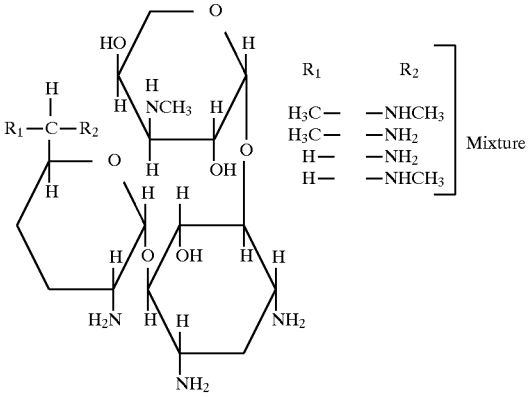

Light-sensitive silver halide emulsion (2) [emulsion for 3rd layer (750 nm-sensitive layer)]

To an aqueous solution having the formulations set forth in Table 4 which had been thoroughly stirred were added simultaneously Solutions (I) and (II) having the formulations set forth in Table 5 in 18 minutes. After 10 minutes, to the mixture were added simultaneously Solutions (III) and (IV) having the formulations set forth in Table 5 in 24 minutes.

TABLE 4

| Composition | |
|---|---|
| $H_2O$ | 620 ml |
| Lime-treated gelatin | 20 g |
| KBr | 0.3 g |
| NaCl | 2 g |
| Silver halide solvent (1) | 0.030 g |
| Sulfuric acid (1N) | 16 ml |
| Temperature | 45° C. |

TABLE 5

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K4[Fe(CN)_6].H_2O$ | | | | 0.07 g |
| $K_2IrCl_6$ | — | — | — | 0.040 mg |
| Total amount (water to make) | 188 ml | 188 ml | 250 ml | 250 ml |

The emulsion was then rinsed and desalted by an ordinary method (pH kept to 3.9 with a precipitant (b)). To the emulsion was then added 22 g of lime-treated osein gelatin (calcium content: 150 ppm or less). The emulsion was then redispersed at a temperature of 40° C. To the emulsion was then added 0.39 g of 4-hydroxy-6-methyl-1,3,3a,7-tetrazaindene so that it was adjusted to pH 5.9 and pAg 7.8. The emulsion was then chemically sensitized at a temperature of 70° C. with compounds set forth in Table 6. At the end of the chemical sensitization, sensitizing dyes (2) and (3) were added to the emulsion in the form of methanol solution (solution having the formulations set forth in Table 7). After the chemical sensitization, the emulsion was allowed to cool to a temperature of 40° C. where 200 g of a gelatin dispersion of a stabilizer (1) described later was then added thereto. The emulsion was thoroughly stirred and then recovered. As a result, 938 g of a monodisperse emulsion of cubic silver bromochloride grains having a coefficient of variation of 12.6% and an average grain size of 0.25 μm was obtained.

TABLE 6

| Composition used in chemical sensitization | Amount added |
|---|---|
| 4-Hydroxy-6-methyl-1,3,3a,7-tetrazaindene | 0.39 g |
| Triethylthiourea | 3.3 mg |
| Decomposition product of nucleic acid | 0.39 g |
| NaCl | 0.15 g |
| KI | 0.12 g |
| Antifoggant (2) | 0.10 g |
| Preservative (1) | 0.07 g |

TABLE 7

| Composition of dye solution | Amount added |
|---|---|
| Sensitizing dye (2) | 0.12 g |
| Sensitizing dye (3) | 0.06 g |
| Paratoluenesulfonic acid | 0.71 g |
| Methanol | 18.7 ml |

Fog inhibitor (2)

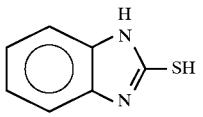

-continued

Sensitizing dye (2)

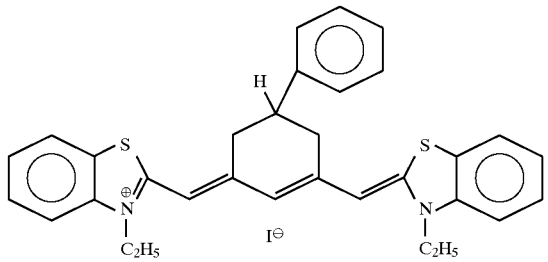

Sensitizing dye (3)

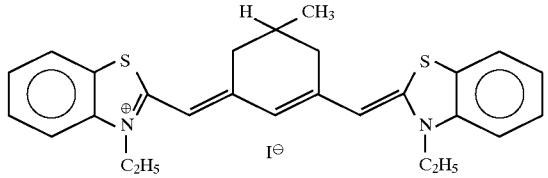

Light-sensitive silver halide emulsion (3) [emulsion for 1st layer (810 nm-sensitive layer)]

To an aqueous solution having the formulations set forth in Table 8 which had been thoroughly stirred were added simultaneously Solutions (I) and (II) having the formulations set forth in Table 9 in 18 minutes. After 10 minutes, to the mixture were added simultaneously Solutions (III) and (IV) having the formulations set forth in Table 9 in 24 minutes.

TABLE 8

| Composition | |
|---|---|
| $H_2O$ | 620 ml |
| Lime-treated gelatin | 20 g |
| KBr | 0.3 g |
| NaCl | 2 g |
| Silver halide solvent (1) | 0.030 g |
| Sulfuric acid (1N) | 16 ml |
| Temperature | 50° C. |

TABLE 9

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total amount (water to make) | 180 ml | 181 ml | 242 ml | 250 ml |

The emulsion was then rinsed and desalted by an ordinary method (pH kept to 3.8 with a precipitant (a)). To the emulsion was then added 22 g of lime-treated osein gelatin so that it was adjusted to pH 7.4 and pAg 7.8. The emulsion was then chemically sensitized at a temperature of 60° C. with compounds set forth in Table 10. As a result, 680 g of a monodisperse emulsion of cubic silver bromochloride grains having a coefficient of variation of 9.7% and an average grain size of 0.32 μm was obtained.

TABLE 10

| Composition used in chemical sensitization | Amount added |
|---|---|
| 4-Hydroxy-6-methyl-1,3,3a,7-tetrazaindene | 0.38 g |
| Triethylthiourea | 3.10 mg |
| Antifoggant (2) | 0.19 g |
| Preservative (1) | 0.07 g |
| Preservative (2) | 3.13 g |

The preparation of a gelatin dispersion of colloidal silver will be described hereinafter.

To an aqueous solution having the formulations set forth in Table 11 which had been thoroughly stirred was added a solution having the formulations set forth in Table 12 in 24 minutes. The emulsion was then flocculated with precipitant (a). The resulting precipitate was then rinsed. To the emulsion was then added 43 g of lime-treated osein gelatin so that it was adjusted to pH 6.3. As a result, 512 g of a gelatin dispersion of colloidal silver having an average grain size of 0.02 $\mu$m was obtained (dispersion containing 2% of silver and 6.8% of gelatin).

TABLE 11

| Composition | |
|---|---|
| $H_2O$ | 620 ml |
| Dextrin | 16 g |
| NaOH (5N) | 41 ml |
| Temperature | 30° C. |

TABLE 12

| Composition | |
|---|---|
| $H_2O$ | 135 ml |
| $AgNO_3$ | 17 g |

The preparation of a gelatin dispersion of hydrophobic additive will be described hereinafter.

Gelatin dispersions of yellow dye-providing compound, magenta dye-providing compound and cyan dye-providing compound were prepared in accordance with the formulations set forth in Table 13. That is, various oil phase components were mixed at a temperature of about 70° C. to make a uniform solution. To the solution was then added aqueous components which had been heated to a temperature of about 60° C. The mixture was stirred, and then subjected to dispersion at 10,000 rpm for 10 minutes. To the dispersion was then added water. The mixture was then stirred to obtain a uniform dispersion. The gelatin dispersion of cyan dye-providing compound was then repeatedly diluted and condensed with water by means of an ultrafiltration module (ultrafiltration module ACV-3050 available from Asahi Chemical Industry Co., Ltd.) so that the amount of ethyl acetate was reduced to 1/17.6 of the initial amount set forth in Table 13.

TABLE 13

| | Composition of dispersion | | |
|---|---|---|---|
| | Yellow | Magenta | Cyan |
| Oil phase | | | |
| Cyan dye-donating compound (1) | — | — | 7.3 g |

TABLE 13-continued

| | Composition of dispersion | | |
|---|---|---|---|
| | Yellow | Magenta | Cyan |
| Cyan dye-donating compound (2) | — | — | 10.7 g |
| Magenta dye-donating compound (1) | — | 18.1 g | — |
| Yellow dye-donating compound (1) | 12.3 g | — | — |
| Reducing agent (1) | 0.9 g | 0.2 g | 1.0 g |
| Antifoggant (3) | 0.1 g | — | 0.2 g |
| Antifoggant (4) | — | 0.7 g | — |
| Surface active agent (1) | 1.1 g | — | — |
| High boiling solvent (1) | 6.2 g | 25.1 g | 4.6 g |
| High boiling solvent (2) | — | — | 4.9 g |
| High boiling solvent (3) | — | — | 1.2 g |
| Dye (a) | 1.1 g | — | 0.5 g |
| Water | 0.4 ml | — | — |
| Ethyl acetate | 9.6 ml | 50.1 ml | 55.2 ml |
| Aqueous phase | | | |
| Lime-treated gelatin | 10.0 g | 10.0 g | 10.0 g |
| Calcium nitrate | 0.1 g | 0.1 g | — |
| Surface active agent (1) | — | 0.2 g | 0.8 g |
| 1N aqueous solution of sodium hydroxide | — | 1.9 ml | — |
| Carboxymethyl cellulose | — | — | 0.3 g |
| Water | 26.1 ml | 139.7 ml | 95.9 ml |
| Water to make | 99.9 ml | 157.3 ml | 209.0 ml |
| Preservative (1) | 0.004 g | 0.04 g | 0.1 g |

A gelatin dispersion of a reducing agent (2) was prepared in accordance with the formulations set forth in Table 14. In some detail, various oil phase components were mixed at a temperature of about 60° C. to make a solution. To the solution were then added various phase components which had been heated to a temperature of about 60° C. The mixture was stirred, and then subjected to dispersion with a homogenizer at 10,000 rpm for 10 minutes to obtain a uniform dispersion. Ethyl acetate was removed from the dispersion by means of a vacuum organic solvent remover.

TABLE 14

| | Composition of dispersion |
|---|---|
| Oil phase | |
| Reducing agent (2) | 7.5 g |
| High boiling agent (1) | 4.7 g |
| Surface active agent (1) | 1.9 g |
| Ethyl acetate | 14.4 ml |
| Aqueous phase | |
| Acid-treated gelatin | 10.0 g |
| Preservative (1) | 0.02 g |
| Preservative (3) | 0.04 g |
| Sodium hydrogensulfite | 0.1 g |
| Water | 136.7 ml |

A gelatin dispersion of a stabilizer (1) was prepared in accordance with the formulations set forth in Table 15. In some detail, various oil phase components were mixed at room temperature to make a solution. To the solution were then added aqueous components which had been heated to a temperature of about 40° C. The mixture was stirred, and then subjected to dispersion at 10,000 rpm by means of a homogenizer for 10 minutes. To the dispersion was then added water. The mixture was then stirred to obtain a uniform dispersion.

TABLE 15

| | Composition of dispersion |
|---|---|
| Oil phase | |
| Stabilizer (1) | 4.0 g |
| Sodium hydroxide | 0.3 g |
| Methanol | 62.8 g |
| High boiling solvent (4) | 0.9 g |
| Aqueous phase | |
| Decalcified gelatin (Ca content: 100 ppm or less) | 10.0 g |
| Antifoggant (1) | 0.04 g |

A gelatin dispersion of zinc hydroxide was prepared in accordance with the formulations set forth in Table 16. In some detail, various components were mixed to make a solution. The solution was subjected to dispersion with glass beads having an average grain diameter of 0.75 mm by means of a mill for 30 minutes. The glass beads were then removed to obtain a uniform dispersion. (The zinc hydroxide grains used had an average grain size of 0.20 μm)

TABLE 16

| | Composition of dispersion |
|---|---|
| Zinc hydroxide | 15.9 g |
| Carboxymethyl cellulose | 0.7 g |
| Sodium polyacrylate | 0.07 g |
| Lime-treated gelatin | 4.2 g |
| Water | 100 ml |
| High boiling solvent (4) | 0.4 g |

The preparation of the gelatin dispersion of matting agent to be incorporated in the protective layer will be described hereinafter. That is, a solution of PMMA in methylene chloride was added to gelatin with a small amount of a surface active agent. The mixture was then stirred at a high speed to effect dispersion. Methylene chloride was then removed by means of a vacuum solvent remover to obtain a uniform dispersion having an average grain size of 3.6 μm.

Cyan dye-providing compound (1)

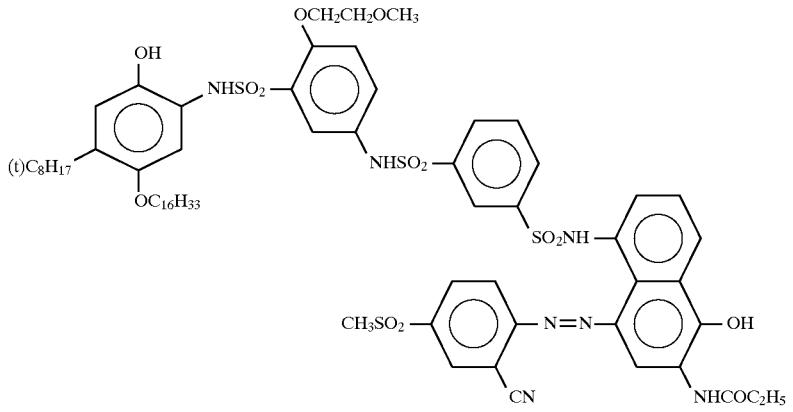

Cyan dye-providing compound (2)

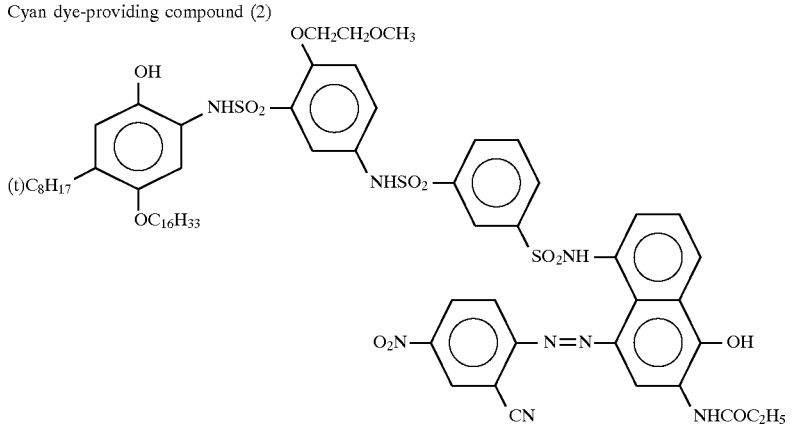

-continued
Magenta dye-providing compound (1)
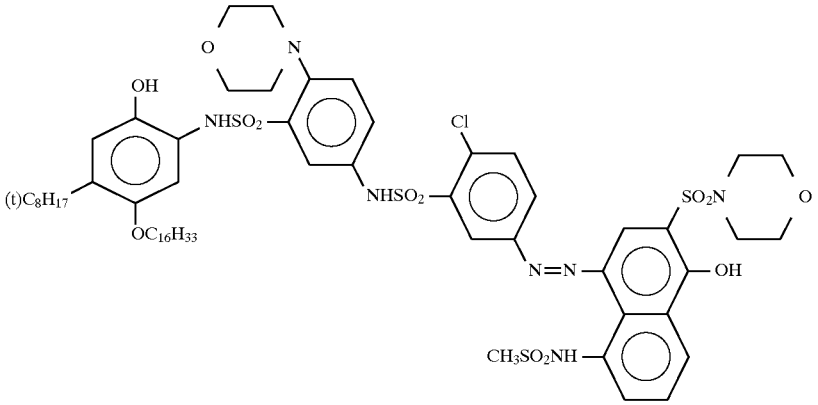
Yellow dye-providing compound (1)
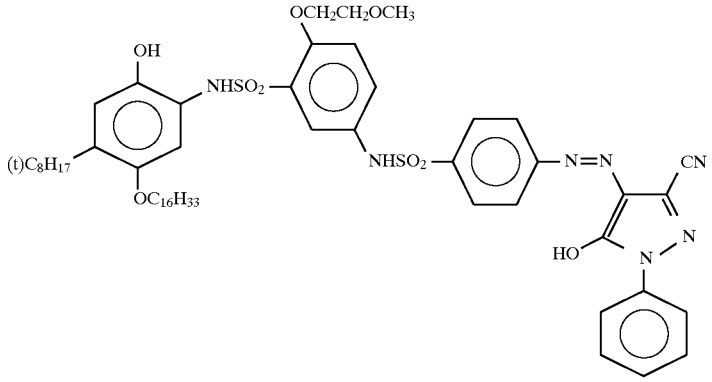
Reducing agent (1)
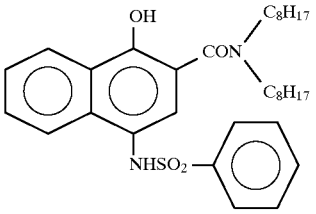
Fog inhibitor (3)
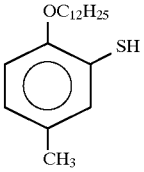
Fog inhibitor (4)
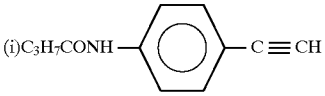

-continued
Surface active agent (1)
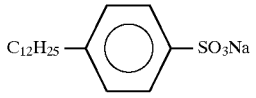
High boiling solvent (1)
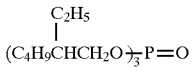
High boiling solvent (2)
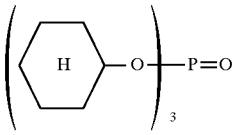
High boiling solvent (3)
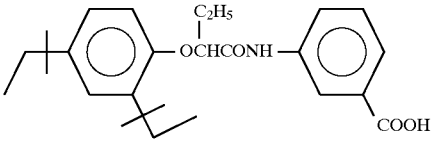
Dye (a)
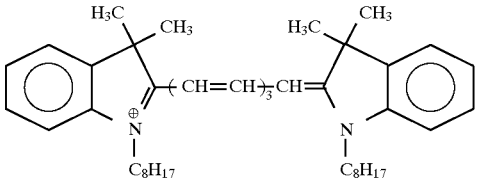
Reducing agent (2)
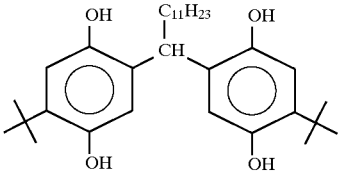
Stabilizer (1)
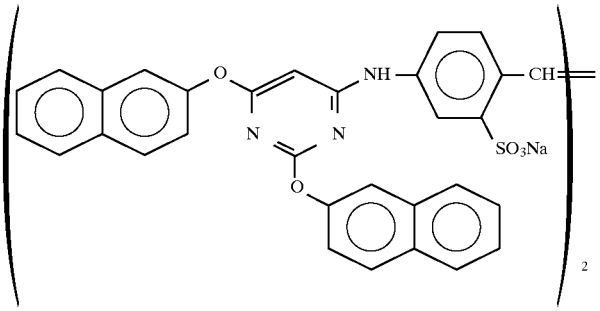

-continued

High boiling organic solvent (4) (same as preservative (2)

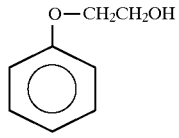

Surface active agent (2)

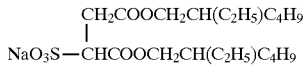

Surface active agent (3)

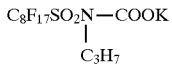

Surface active agent (4)

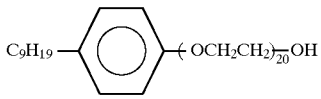

The foregoing materials were used to prepare a heat-developable light-sensitive material 100 set forth in Tables 17 and 18.

TABLE 17

Main constituents of heat-developable color light-sensitive material 100

| Layer Coated No. amount ($mg/m^2$) | Layer name | Additive | |
|---|---|---|---|
| 7th Layer | Protective layer | Acid-treated gelatin | 442 |
| | | Reducing agent (2) | 47 |
| | | High boiling solvent (1) | 30 |
| | | Particulate colloidal silver | 2 |
| | | Matting agent (PMMA resin) | 17 |
| | | Surface active agent (2) | 16 |
| | | Surface active agent (1) | 9 |
| | | Surface active agent (3) | 2 |
| 6th Layer | Interlayer | Lime-treated gelatin | 862 |
| | | Zinc hydroxide | 480 |
| | | Water-soluble polymer (1) | 4 |
| | | Surface active agent (2) | 0.4 |
| | | Calcium nitrate | 14 |
| 5th Layer | Red-sensitive layer | Lime-treated gelatin | 452 |
| | | Light-sensitive silver halide emulsion (1) | 301 in terms of silver |
| | | Magenta dye-donating compound (1) | 441 |
| | | High-boiling solvent (2) | 221 |
| | | Reducing agent (1) | 6 |
| | | Antifoggant (4) | 20 |
| | | Surface active agent (1) | 0.3 |
| | | Water-soluble polymer (1) | 11 |
| 4th layer | Interlayer | Lime-treated gelatin | 485 |
| | | Zinc hydroxide | 270 |
| | | Water-soluble polymer (1) | 2 |
| | | Surface active agent (2) | 0.3 |
| | | Calcium nitrate | 8 |
| 3rd layer | 2nd infrared-sensitive | Lime-treated gelatin | 373 |
| | | Light-sensitive silver halide emulsion (2) | 106 in terms |

TABLE 17-continued

Main constituents of heat-developable color light-sensitive material 100

| Layer Coated No. amount ($mg/m^2$) | Layer name | Additive | |
|---|---|---|---|
| | layer | | of silver |
| | | Stabilizer (1) | 9 |
| | | Cyan dye-donating compound (2) | 233 |
| | | Cyan dye-donating compound (1) | 159 |
| | | Dye (a) | 10 |
| | | High boiling solvent (1) | 101 |
| | | High boiling solvent (2) | 108 |
| | | High boiling solvent (3) | 27 |
| | | Reducing agent (1) | 22 |
| | | Antifoggant (3) | 4 |
| | | Surface active agent (1) | 0.9 |
| | | Carboxymethyl cellulose | 5 |
| 2nd layer | Interlayer | Lime-treated gelatin | 438 |
| | | Surface active agent (2) | 4 |
| | | Surface active agent (4) | 123 |
| | | Water-soluble polymer (2) | 26 |
| | | Antifoggant (5) | 6 |
| | | Calcium nitrate | 8 |
| 1st layer | 1st infrared-sensitive layer | Lime-treated gelatin | 587 |
| | | Light-sensitive silver halide emulsion (3) | 311 in terms of silver |
| | | Stabilizer (1) | 8 |
| | | Yellow dye-donating compound (1) | 504 |
| | | Sensitizing dye (4) | 0.1 |
| | | Dye (a) | 44 |
| | | High boiling solvent (1) | 252 |
| | | Reducing agent (1) | 35 |
| | | Antifoggant (3) | 4 |
| | | Surface active agent (1) | 32 |
| | | Water-soluble polymer (2) | 46 |
| | | Film hardener (1) | 45 |

TABLE 17-continued

| Main constituents of heat-developable color light-sensitive material 100 | | |
|---|---|---|
| Layer Coated No. amount ($mg/m^2$) | Layer name | Additive |
| Support (paper supported laminated with polyethylene: thickness: 131 $\mu$m) | | |

Note: Additives to be added in a slight amount, e.g., preservative are omitted.

Surface active agent (2)

$$\begin{array}{l} \quad\quad CH_2COOCH_2CH(C_2H_5)C_4H_9 \\ \quad\quad\quad | \\ NaO_3S-CHCOOCH_2CH(C_2H_5)C_4H_9 \end{array}$$

Surface active agent (3)

$$\begin{array}{l} C_8F_{17}SO_2N-COOK \\ \quad\quad\quad | \\ \quad\quad C_3H_7 \end{array}$$

Surface active agent (4)

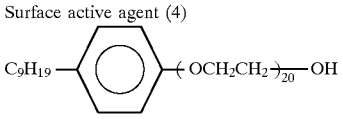

Water-soluble polymer (1)

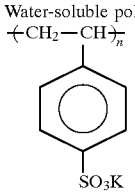

Intrinsic viscosity [ η ] = 1.6
(0.1 N NaCl, 30° C.)

Molecular weight ≈ 1,000,000

Sensitizing dye (4)

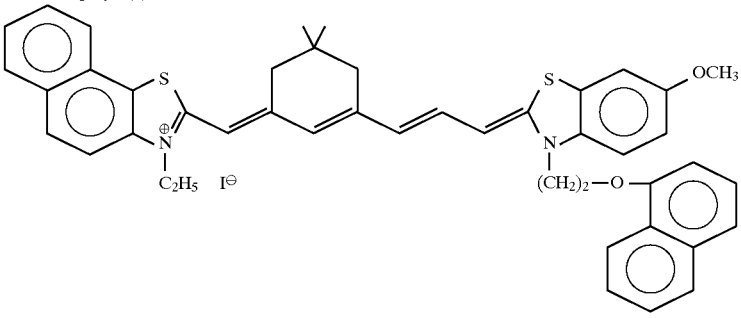

Fog inhibitor (5)

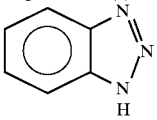

Film hardener (1)

$CH_2=CHSO_2CH_2SO_2CH=CH_2$

The preparation of a light-sensitive material 101 will be described hereinafter.

The light-sensitive material 101 was prepared in the same manner as in the light-sensitive material 100 except that the yellow dye-providing compound (1) to be contained in the yellow dispersion to be incorporated in the 1st layer was replaced by 9.9 g of a yellow dye-providing compound (2) having the following structural formula and 6.2 g of a development accelerator having the following structural formula was emulsion-dispersed in an oil phase of the yellow dispersion set forth in Table 13.

Yellow dye-providing compound (2)

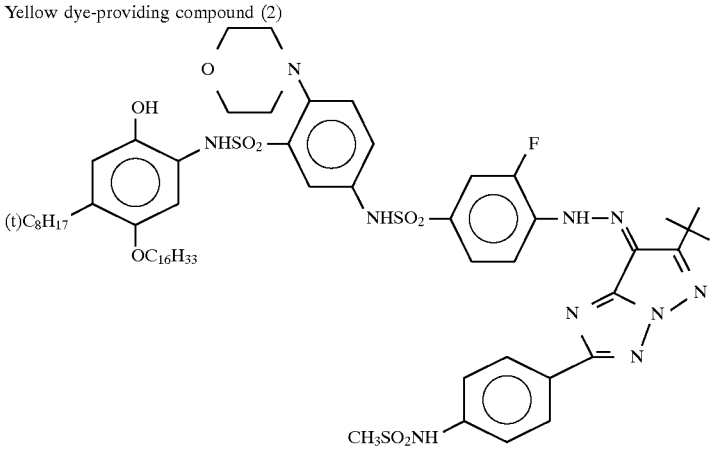

Development accelerator

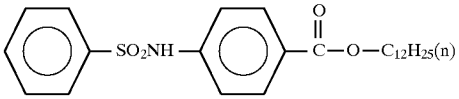

The preparation of light-sensitive materials 102 to 115 will be described hereinafter.

Firstly, the preparation of fine emulsion of high silver chloride content grains (1a) to (1g) will be described hereinafter.

To an aqueous solution having the formulations set forth in Table 18 which had been thoroughly stirred were added simultaneously Solutions (I) and (II) having the formulations set forth in Table 19 in 4 minutes. After 5 minutes, to the mixture were added simultaneously Solutions (III) and (IV) having the formulations set forth in Table 20 in 8 minutes. When 2 minutes passed after the addition of Solutions (III) and (IV), 0.7 g of 4-hydroxy-6-methyl-1,3,3a,7-tetrazaindene was added to the mixture. The emulsion was then rinsed and desalted by an ordinary method (pH kept to 3.9 with a precipitant (a)). To the emulsion was then added 22 g of lime-treated osein gelatin so that it was adjusted to pH 5.7 and pAg 6.8. As a result, 530 g of a monodisperse emulsion (1a) of silver chloride grains having an average grain size of 0.08 μm was obtained.

TABLE 18

| Composition | |
|---|---|
| $H_2O$ | 630 ml |
| Lime-treated gelatin | 10 g |
| NaCl | 0.15 g |
| Temperature | 38° C. |

TABLE 19

| | Solution (I) | Solution (II) | Solution (III) | Solution (IV) |
|---|---|---|---|---|
| $AgNO_3$ | 50 g | — | 50 g | — |
| NaCl | — | 23 g | — | 23 g |
| Total amount (water to make) | 100 ml | 100 ml | 100 ml | 100 ml |

An emulsion (1b) was prepared in the same manner as in the emulsion (1a) except that Solutions (I) to (IV) having the formulations set forth in Table 20 were added. As a result, 530 g of a monodisperse emulsion of silver bromochloride grains (Br content: 10 mol %) having an average grain size of 0.08 μm was obtained.

TABLE 20

| | Solution (I) | Solution (II) | Solution (III) | Solution (IV) |
|---|---|---|---|---|
| $AgNO_3$ | 50 g | — | 50 g | — |
| NaCl | — | 21 g | — | 21 g |
| KBr | — | 3.5 g | — | 3.5 g |
| Total amount (water to make) | 100 ml | 100 ml | 100 ml | 100 ml |

An emulsion (1c) was prepared in the same manner as in the emulsion (1a) except that Solutions (I) to (IV) having the formulations set forth in Table 21 were added. As a result, 530 g of a monodisperse emulsion of silver bromochloride grains (Br content: 20 mol %) having an average grain size of 0.08 μm was obtained.

TABLE 21

| | Solution (I) | Solution (II) | Solution (III) | Solution (IV) |
|---|---|---|---|---|
| $AgNO_3$ | 50 g | — | 50 g | — |
| NaCl | — | 19 g | — | 19 g |
| KBr | — | 7 g | — | 7g |
| Total amount (water to make) | 100 ml | 100 ml | 100 ml | 100 ml |

An emulsion (1b) was prepared in the same manner as in the emulsion (1d) except that Solutions (I) to (IV) having the formulations set forth in Table 22 were added. As a result, 530 g of a monodisperse emulsion of silver bromochloride grains (Br content: 40 mol %) having an average grain size of 0.08 μm was obtained.

TABLE 22

| | Solution (I) | Solution (II) | Solution (III) | Solution (IV) |
|---|---|---|---|---|
| $AgNO_3$ | 50 g | — | 50 g | — |
| NaCl | — | 16 g | — | 16 g |
| KBr | — | 14 g | — | 14 g |
| Total amount (water to make) | 100 ml | 100 ml | 100 ml | 100 ml |

Emulsions (1e), (1f) and (1g) having an average grain size of 0.12 μm, 0.20 μm and 0.05 μm, respectively, were prepared in the same manner as in the emulsion (1a) except that the temperature of the aqueous solution set forth in Table 18 were 42° C., 50° C. and 32° C., respectively. The yield of these emulsions were each 530 g.

Light-sensitive materials 102 to 115 were prepared from these emulsions in the same manner as the light-sensitive material 100 except that alteration was made as set forth in Table 23.

TABLE 23

| | First layer | | | Third layer | | |
|---|---|---|---|---|---|---|
| Light-sensitive material | Yellow dye-donating compound | Additive | Amount added ($mg/m^2$) | Additive | Amount added ($mg/m^2$) | Remarks |
| 100 | (1) | — | — | — | — | Comparison |
| 101 | (2) | — | — | — | — | " |
| 102 | (2) | Emulsion (1a) | 40 | — | — | Invention |
| 103 | (2) | Emulsion (1a) | 80 | — | — | " |
| 104 | (2) | Emulsion (1a) | 10 | — | — | " |
| 105 | (2) | Emulsion (1b) | 40 | — | — | " |
| 106 | (2) | Emulsion (1c) | 40 | — | — | " |
| 107 | (2) | Emulsion (1d) | 40 | — | — | Comparison |
| 108 | (2) | Emulsion (1e) | 40 | — | — | Invention |
| 109 | (2) | Emulsion (1f) | 40 | — | — | " |
| 110 | (2) | Emulsion (1g) | 40 | — | — | " |
| 111 | (1) | Emulsion (1a) | 40 | — | — | " |
| 112 | (2) | — | — | Emulsion (1a) | 40 | " |
| 113 | (2) | — | — | Emulsion (1a) | 80 | " |
| 114 | (2) | $AgNO_3$ | 20 | — | — | " |
| 115 | (2) | $AgNO_3$ | 80 | — | — | " |

These light-sensitive materials 100 to 115 were each by a Type PG-3000 digital color printer Fujix Pictrography available from Fiji Photo Film Co., Ltd. with PG-SG for PG-3000 as a dye-fixing material to effect image output. In some detail, a solid gray image was first outputted in an atmosphere of 25° C. and 50% RH. The tint of the image was properly adjusted. Under the same exposure conditions, image output was effected in an atmosphere of 15° C. and 50% RH and 30° C. and 50% RH. The gray images obtained in these atmospheres were then measured for density by means of a Type X-rite 304 reflection densitometer available from X-rite Corp.

The change in color balance between the sample outputted at 15° C. and 50% RH and the sample outputted at 30° C. and 50% RH was visually judged.

Using an exposure apparatus comprising an optical system as described in FIG. 2 of JP-A-6-127021, these photographic light-sensitive materials were then subjected to sensitometry under the conditions set forth in Table 24 at 15° C. and 50% RH, 25° C. and 50% RH and 30° C. and 50% RH in an environmental testing chamber to determine gradation $\gamma_Y$, $\gamma_M$ and $\gamma_C$ at 25° C. and 50% RH and temperature dependence of sensitivity $\Delta S_Y$, $\Delta S_M$ and $\Delta S_C$.

A gray image having Y, M and C color reflection densities of 1.0 was outputted each on these photographic light-sensitive materials under standard image outputting conditions at 25° C. and 50% RH under the conditions set forth in Table 25. Thereafter, the heat development temperature was changed to +5° C. and −5° C. The other conditions were not changed. Under these conditions, a grain image was then outputted each on these photographic light-sensitive materials. The images thus obtained were each measured for change of color densities by means of a Type X-rite 304 reflection densitometer.

TABLE 24

| | |
|---|---|
| Beam intensity on photographic light-sensitive material | Intensity of 675 nm laser beam: 60 μW<br>Intensity of 755 nm laser beam: 250 μW<br>Intensity of 815 nm laser beam: 250 μW |
| Density of Scanning line | 1,600 dpi (63 lasters per mm) |
| Beam diameter | 85 ± 8.5 μm in the direction of main scanning<br>55 ± 5.5 μm in the direction of subsidiary scanning |
| Exposure time | 667 μsec per laster<br>Repetition frequency: 1.33 msec |
| Exposure wavelength | 675, 755, 815 nm (laser beam) |
| Exposure | 1 logE change per 2.5 cm in the direction of subsidiary scanning |
| Method for changing exposure | Light emission time modulation (as described in JP-A-5-199372) |

TABLE 25

| Light-sensitive | Dependency on exposure temperature | | | | | | | | Density variation (±5° C.) | | | |
|---|---|---|---|---|---|---|---|---|---|---|---|---|
| material | $\gamma_Y$ | $\gamma_M$ | $\gamma_C$ | $\Delta S_Y$ | $\Delta S_M$ | $\Delta S_C$ | ΔCB | visual judge | Y | M | C | Remarks |
| 100 | 3.8 | 4.0 | 3.9 | 0.07 | 0.05 | 0.15 | 0.39 | fair | 0.20 | 0.30 | 0.35 | Comparison |
| 101 | 3.9 | 4.1 | 3.8 | 0.07 | 0.06 | 0.17 | 0.40 | fair | 0.17 | 0.34 | 0.33 | " |

TABLE 25-continued

| Light-sensitive material | Dependency on exposure temperature | | | | | | | | Density variation (±5° C.) | | | Remarks |
|---|---|---|---|---|---|---|---|---|---|---|---|---|
| | $\gamma_Y$ | $\gamma_M$ | $\gamma_C$ | $\Delta S_Y$ | $\Delta S_M$ | $\Delta S_C$ | ΔCB | visual judge | Y | M | C | |
| 102 | 4.0 | 4.1 | 3.9 | 0.05 | 0.05 | 0.10 | 0.19 | very good | 0.12 | 0.20 | 0.23 | Invention |
| 103 | 4.0 | 4.2 | 3.9 | 0.03 | 0.05 | 0.10 | 0.27 | good | 0.11 | 0.19 | 0.22 | " |
| 104 | 3.9 | 4.1 | 3.9 | 0.06 | 0.05 | 0.14 | 0.34 | good | 0.15 | 0.29 | 0.28 | " |
| 105 | 3.9 | 4.1 | 3.9 | 0.06 | 0.05 | 0.13 | 0.30 | good | 0.14 | 0.26 | 0.25 | " |
| 106 | 3.9 | 4.2 | 3.9 | 0.06 | 0.05 | 0.15 | 0.38 | fair | 0.15 | 0.28 | 0.27 | " |
| 107 | 3.9 | 4.2 | 3.9 | 0.07 | 0.05 | 0.16 | 0.41 | fair | 0.18 | 0.35 | 0.35 | Comparison |
| 108 | 4.0 | 4.1 | 3.9 | 0.05 | 0.05 | 0.11 | 0.23 | very good | 0.13 | 0.22 | 0.23 | Invention |
| 109 | 3.9 | 4.1 | 3.8 | 0.06 | 0.05 | 0.15 | 0.37 | fair | 0.15 | 0.28 | 0.28 | " |
| 110 | 3.9 | 4.1 | 3.9 | 0.04 | 0.05 | 0.11 | 0.27 | good | 0.11 | 0.20 | 0.19 | " |
| 111 | 3.8 | 4.2 | 4.0 | 0.04 | 0.05 | 0.10 | 0.25 | good | 0.15 | 0.23 | 0.25 | " |
| 112 | 4.0 | 4.1 | 3.9 | 0.06 | 0.05 | 0.12 | 0.23 | very good | 0.13 | 0.21 | 0.21 | " |
| 113 | 4.0 | 4.1 | 3.9 | 0.05 | 0.04 | 0.11 | 0.27 | good | 0.11 | 0.20 | 0.20 | " |
| 114 | 4.0 | 4.1 | 4.0 | 0.05 | 0.04 | 0.10 | 0.24 | very good | 0.10 | 0.18 | 0.19 | " |
| 115 | 4.1 | 4.1 | 4.2 | 0.03 | 0.04 | 0.10 | 0.28 | good | 0.09 | 0.17 | 0.18 | " |

The results of Table 25 show that the light-sensitive materials of the present invention exhibit less image color balance change against the environmental temperature change during exposure than the comparative light-sensitive materials. It can thus be seen that the light-sensitive materials of the present invention are excellent. It is also shown that the light-sensitive materials of the present invention exhibit less image density change against the change in the processing temperature.

As mentioned above, the light-sensitive materials of the present invention exhibit a minimized image density change against the processing temperature change during the heat development and a minimized image color balance change against the change in environmental conditions (particularly temperature) during exposure, providing an image with an excellent discrimination between image area and non-image area.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a support having provided thereon at least two layers having a spectral sensitivity peak in a different wavelength range of 700 nm or more, in which at least two of the at least two layers are each combined with a compound which provides a dye having a different hue, wherein the layer having a spectral sensitivity peak in the longest wavelength, a light-insensitive interlayer adjacent thereto or both the layer having a spectral sensitivity peak in the longest wavelength and the light-insensitive interlaver adjacent thereto comprise (a) a substantially insensitive, high silver chloride emulsion of fine grains having a silver chloride content of 80 mol % or more and an average size of 0.15 $\mu$m or less or (b) an easily soluble silver salt compound in combination with silver halide having a spectral sensitivity peak in the longest wavelength, wherein "substantially insensitive" herein means that the sensitivity of the high silver chloride emulsion of fine grains is lower than that of the light-sensitive silver halide having a spectral sensitivity peak in the longest wavelength by 1.0 Log E or greater.

2. The heat-developable color light-sensitive material as claimed in claim 1, wherein the compound which provides a dye combined with the layer having a spectral sensitivity peak in the longest wavelength is a compound represented by the following formula (1):

$$[(\text{Dye})_p\text{X}]_q\text{Y} \quad (1)$$

wherein Dye represents a dye group or dye precursor group represented by the following formula (2); Y represents a group which makes difference in diffusibility of the dye component in correspondence or reverse correspondence to a reduction reaction of light-sensitive silver halide having an imagewise latent image to silver; X represents a single bond or bonding group; p is an integer of 1 or more; and q is 1 or 2, with the proviso that when p is 2 or more, or when q is 2, the plurality of Dye's or $((\text{Dye})_p\text{—X})$'s may be the same or different:

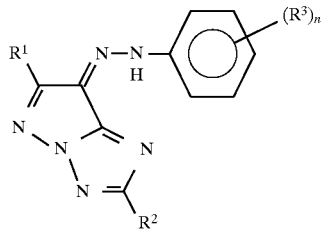

(2)

wherein $R^3$ represents a substituent selected from the group consisting of a halogen atom, hydroxyl group, cyano group, nitro group, carboxyl group, alkyl group, aralkyl group, cycloalkyl group, aryl group, heterocyclic group, alkoxy group, aryloxy group, amino group, acylamino group, sulfonylamino group, acyl group, sulfonyl group, carbamoyl group, sulfamoyl group, ureido group, alkylthio group and arylthio group; $R^1$ and $R^2$ each independently represents a hydrogen atom or the substituent defined in $R^3$; and n is an integer of 0 to 5, with the proviso that when n is from 2 to 5, the plurality of $R^3$'s may be the same or different; and Dye and X are bonded to each other at any one of $R^1$, $R^2$ and $R^3$.

3. The heat-developable color light-sensitive material as claimed in claim 1, wherein the easily soluble silver salt compound is silver nitrate, silver fluoride, silver perchlorate, silver hexafluorophosphate(V) or potassium dicyanoargentate(I).

4. The heat-developable color light-sensitive material as claimed in claim 1, wherein the easily soluble silver compound is silver nitrate or silver fluoride.

5. The heat developable color light-sensitive material as claimed in claim 1, wherein the heat developable color light-sensitive material is subjected to scanning exposure with high illumination intensity for a short time of not greater than one thousandth of a second using an exposure light source such as a semiconductor laser (LD) and a light-emitting diode (LED).

6. The heat-developable color light-sensitive material as claimed in claim 1, wherein an easily soluble silver salt compound is present in the layer having a spectral sensitivity peak in the longest wavelength, the light-insensitive interlayer adjacent thereto or both the layer having a spectral sensitivity peak in the longest wavelength and the light-insensitive interlayer adjacent thereto.

7. The heat-developable color light-sensitive material as claimed in claim 6, wherein the easily soluble silver salt compound is silver nitrate, silver fluoride, silver perchlorate, silver hexafluorophosphate(V) or potassium dicyanoargentate(I).

8. The heat-developable color light-sensitive material as claimed in claim 7, wherein the easily soluble silver salt compound is silver nitrate.

9. The heat-developable color light-sensitive material as claimed in claim 7, wherein the easily soluble silver salt compound is silver fluoride.

10. The heat-developable color light-sensitive material as claimed in claim 7, wherein the easily soluble silver salt compound is silver perchlorate.

11. The heat-developable color light-sensitive material as claimed in claim 7, wherein the easily soluble silver salt compound is silver hexafluorophosphate(V).

12. The heat-developable color light-sensitive material as claimed in claim 7, wherein the easily soluble silver salt compound is potassium dicyanoargentate(I).

* * * * *